US007827947B2

(12) United States Patent
Ichinosawa et al.

(10) Patent No.: US 7,827,947 B2
(45) Date of Patent: Nov. 9, 2010

(54) VARIABLE DISPLACEMENT PUMP, VALVE TIMING CONTROL DEVICE USING THE VARIABLE DISPLACEMENT PUMP, AND VALVE TIMING CONTROL SYSTEM USING THE VARIABLE DISPLACEMENT PUMP, FOR USE IN INTERNAL COMBUSTION ENGINES

(75) Inventors: Yoshinori Ichinosawa, Atsugi (JP); Hideaki Ohnishi, Atsugi (JP); Yasushi Watanabe, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 268 days.

(21) Appl. No.: 12/187,726

(22) Filed: Aug. 7, 2008

(65) Prior Publication Data

US 2009/0101092 A1 Apr. 23, 2009

(30) Foreign Application Priority Data

Oct. 17, 2007 (JP) ..... 2007-269631

(51) Int. Cl.
*F01L 1/34* (2006.01)

(52) U.S. Cl. ..... 123/90.17; 123/90.15; 123/90.65; 418/24; 464/160

(58) Field of Classification Search ..... 123/90.15, 123/90.16, 90.17, 90.18, 65, 66, 67; 464/1, 464/2, 160; 418/24, 25, 26, 27
See application file for complete search history.

(56) References Cited

FOREIGN PATENT DOCUMENTS

JP 2002-371811 A 12/2002

*Primary Examiner*—Ching Chang
(74) *Attorney, Agent, or Firm*—Foley & Lardner LLP

(57) ABSTRACT

A variable displacement pump including a chamber volume varying mechanism including a moveable member, a first biasing member always biasing the moveable member in such a direction as to increase volumes of the working fluid chambers, and a second biasing member that is disposed with a set load and applies a biasing force to the moveable member in such a direction as to increase the volumes of the working fluid chambers when the moveable member is displaced against a biasing force of the first biasing member by a predetermined amount or more. The biasing force of the first biasing member is set such that before the moveable member is displaced against the biasing force of the first biasing member, the valve timing control device is shifted to a release state in which an open-and-closure timing of an engine valve is variably controlled.

20 Claims, 12 Drawing Sheets

VARIABLE DISPLACEMENT PUMP, VALVE TIMING CONTROL DEVICE USING THE VARIABLE DISPLACEMENT PUMP, AND VALVE TIMING CONTROL SYSTEM USING THE VARIABLE DISPLACEMENT PUMP, FOR USE IN INTERNAL COMBUSTION ENGINES

BACKGROUND OF THE INVENTION

The present invention relates to a variable displacement pump, a valve timing control device using the variable displacement pump, and a valve timing control system using the variable displacement pump, for use in internal combustion engines.

Japanese Patent Application First Publication No. 2002-371811 discloses a valve timing control device for internal combustion engines which is of a so-called vane type and includes a phase-advance hydraulic chamber and a phase-retard hydraulic chamber which are separated from each other within a housing by a partition portion of the housing and a vane member with a plurality of blades. The vane member is rotated in a positive rotation direction or a negative rotation direction to thereby selectively conduct supply and discharge of an oil pressure fed from an oil pump that is driven by an internal combustion engine, with respect to the phase-advance hydraulic chamber and the phase-retard hydraulic chamber. The valve timing control device thus variably controls an open-and-closure timing of an engine valve depending on an engine operating condition.

SUMMARY OF THE INVENTION

However, in the valve timing control device of the above-described conventional art, the valve timing control device must be actuated to vary an open-and-closure timing of the engine valve immediately after the start-up of the engine at which fluid pressure is not sufficiently increased. Therefore, it is necessary to use an oil pump having a large discharge capacity in order to operate the valve timing control device. In such a case that the valve timing control device adopts the oil pump having a large discharge capacity, an amount of oil which is discharged from the oil pump becomes larger than required, when engine speed (the number of pump rotation) reaches a predetermined value or more. This leads to a technical problem that causes useless excess discharge of the oil.

It is an object of the present invention to solve the above-described technical problem in the conventional art and provide a technique capable of sufficiently reducing energy consumption in a variable displacement pump that can variably discharge an oil flow in accordance with the number of pump rotation, by actuating a valve timing control device using the variable displacement pump.

In one aspect of the present invention, there is provided a variable displacement pump for supplying a fluid pressure to a valve timing control device that has a lock state at engine start-up in which variable control of an open-and-closure timing of an engine valve of an internal combustion engine is restrained, and a release state after engine start-up in which the variable control of an open-and-closure timing of an engine valve is allowed by a fluid pressure, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed with a set load and applies a biasing force to the moveable member in such a direction as to increase the volumes of the working fluid chambers when the moveable member is displaced against a biasing force of the first biasing member by a predetermined amount or more, wherein the biasing force of the first biasing member is set such that the valve timing control device is shifted to the release state according to the discharge fluid pressure before the moveable member is displaced against the biasing force of the first biasing member.

In a further aspect of the present invention, there is provided a variable displacement pump for supplying a fluid pressure for actuating a valve timing control device that variably controls an open-and-closure timing of an engine valve of an internal combustion engine, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed with a set load and applies a biasing force to the moveable member in such a direction as to increase the volumes of the working fluid chambers when the moveable member is displaced against a biasing force of the first biasing member by a predetermined amount or more, wherein the biasing force of the first biasing member is set such that the valve timing control device is actuated by the discharge fluid pressure under a condition that the moveable member is urged by only the biasing force of the first biasing member.

In a still further aspect of the present invention, there is provided a valve timing control system for an internal combustion engine, comprising:

a valve timing control device that has a lock state at engine start-up in which variable control of an open-and-closure timing of an engine valve of the engine is restrained, and a release state after engine start-up in which the variable control of an open-and-closure timing of an engine valve is allowed by a fluid pressure; and a variable displacement pump that supplies the fluid pressure to the valve timing control device, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed with a set load and applies a biasing force to the moveable member in such a direction as to increase the volumes of the working fluid chambers when the moveable member is displaced against a biasing force of the first biasing member by a predetermined amount or more, wherein the biasing force of the first biasing member is set such that the valve timing control device is shifted to the release state according to the discharge fluid pressure before the moveable member is displaced against the biasing force of the first biasing member.

In a still further aspect of the present invention, there is provided a valve timing control device for variably controlling an open-and-closure timing of an engine valve of an internal combustion engine, the valve timing control device comprising:

a variable displacement pump that supplies a fluid pressure to the valve timing control device, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed at a compressed state and applies a biasing force to the moveable member in such a direction as to increase the volumes of the working fluid chambers when the moveable member is displaced against a biasing force of the first biasing member by a predetermined amount or more, wherein the valve timing control device is constructed to be actuated to variably control the open-and-closure timing of the engine valve by the discharge pressure of the working fluid under a condition that the moveable member is urged by the biasing force of the first biasing member.

The other objects and features of this invention will become understood from the following description with reference to the accompanying drawings.

DETAILED DESCRIPTION OF THE INVENTION

Figure 1:
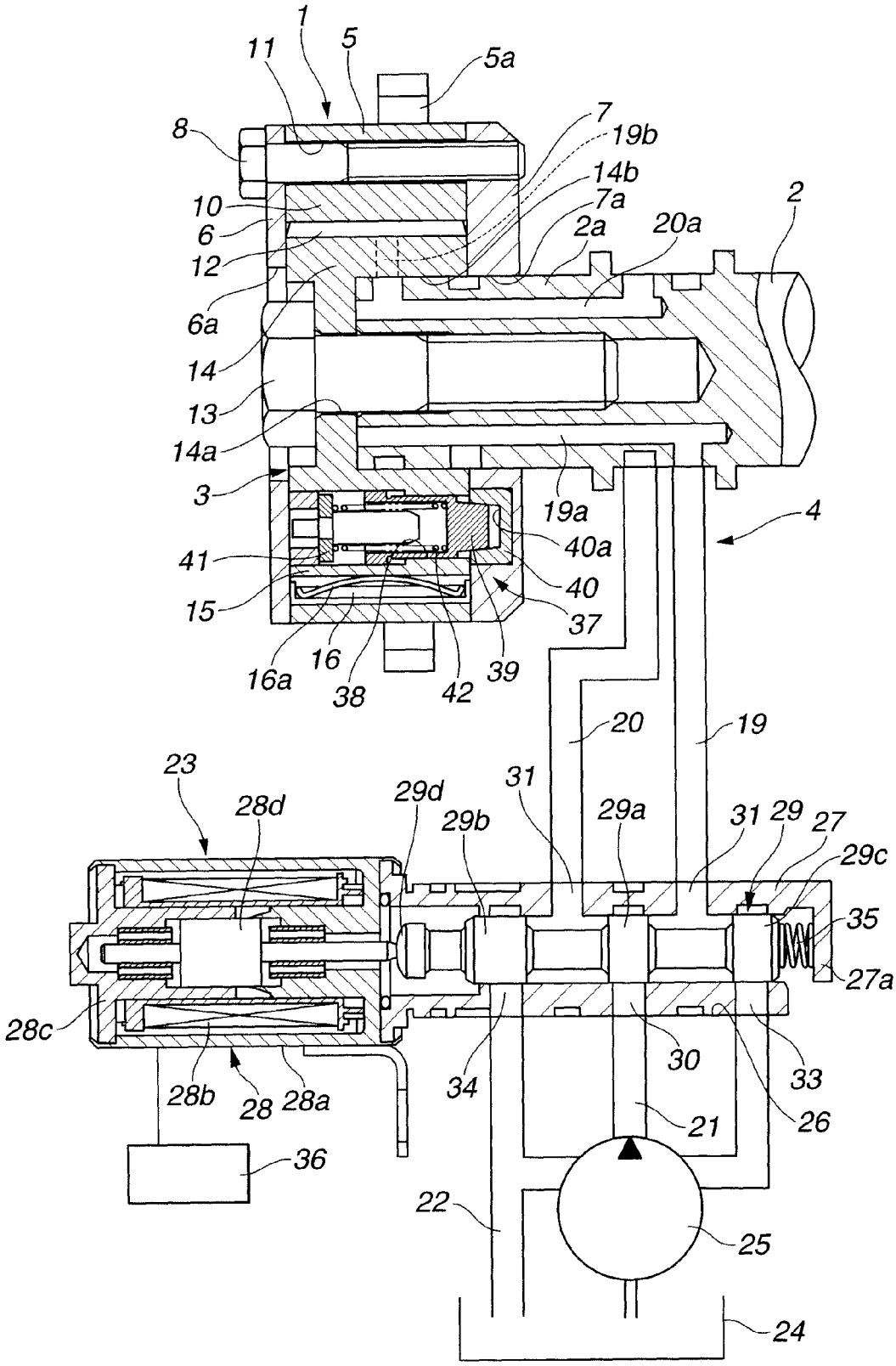
FIG. 1 is a diagram of a valve timing control device according to an embodiment of the present invention, which is shown partly in cross-section.

Referring now to FIG. 1 through FIG. 14C, a variable displacement pump, a valve timing control system using the variable displacement pump, and a valve timing control device using the variable displacement pump, for use in an internal combustion engine for automobiles, according to an embodiment of the present invention, are explained. In this embodiment, the variable displacement pump is applied to an oil pump that supplies a lubricating oil to both the valve timing control device and sliding portions of the engine. For ease of understanding, various directional terms, such as right, left, upper, lower, rightward and the like are used in the description. However, such terms are to be understood with respect to only a drawing or drawings on which a corresponding part or portion is shown.

In the embodiment, the valve timing control device that variably controls an open-and-closure timing of an engine valve is applied to an intake side of the engine. As shown in FIG. 1 to FIG. 4, the valve timing control device includes timing sprocket 1 that is rotatively driven by a crankshaft of the engine via a timing chain, camshaft 2 that is disposed to be rotatable relative to timing sprocket 1, vane member 3 that is fixed to an end portion of camshaft 2, fluid pressure supply and discharge mechanism 4 for rotating vane member 3 in a positive rotation direction and a reverse rotation direction by using a fluid pressure (i.e., hydraulic pressure), and lock mechanism 37 for restraining rotation of vane member 3 relative to timing sprocket 1 and releasing vane member 3 from the restraint. Timing sprocket 1 serves as a driving rotary member. Vane member 3 is rotatably disposed within timing sprocket 1 and serves as a driven rotary member.

Timing sprocket 1 includes housing 5 in which vane member 3 is rotatably accommodated, front cover 6 that closes a front end opening of housing 5, and rear cover 7 that closes a rear end opening of housing 5. Housing 5 has teeth 5*a* on an outer circumferential surface thereof which is integrally formed with timing sprocket 1. Housing 5, front cover 6 and rear cover 7 are fastened to each other by means of small-diameter bolts 8 that extends in an axial direction of camshaft 2.

Figure 2:
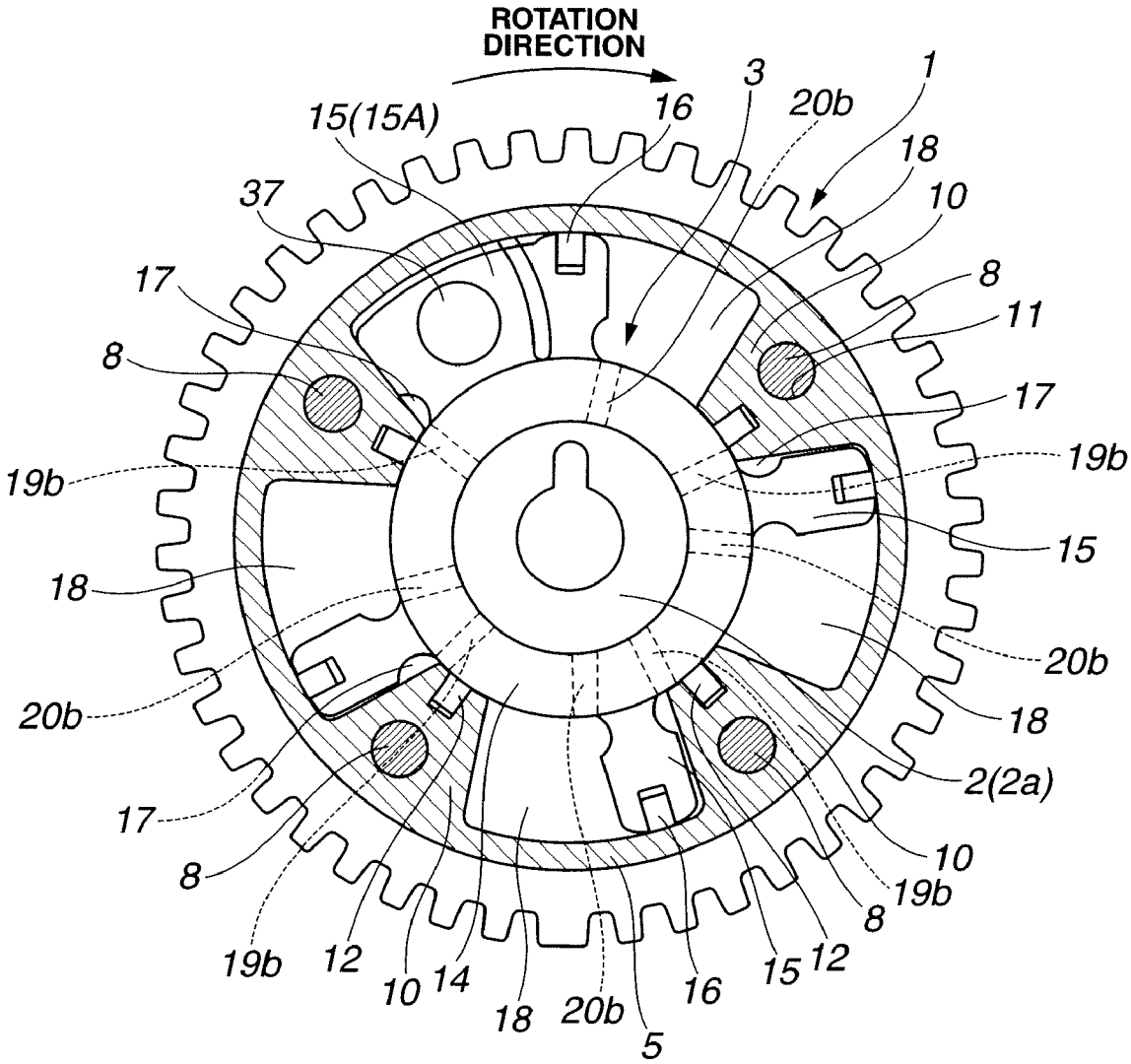
FIG. 2 is a cross-section of the valve timing control device of the embodiment, which shows a vane member placed in a maximum phase-retard position.
Figure 3:
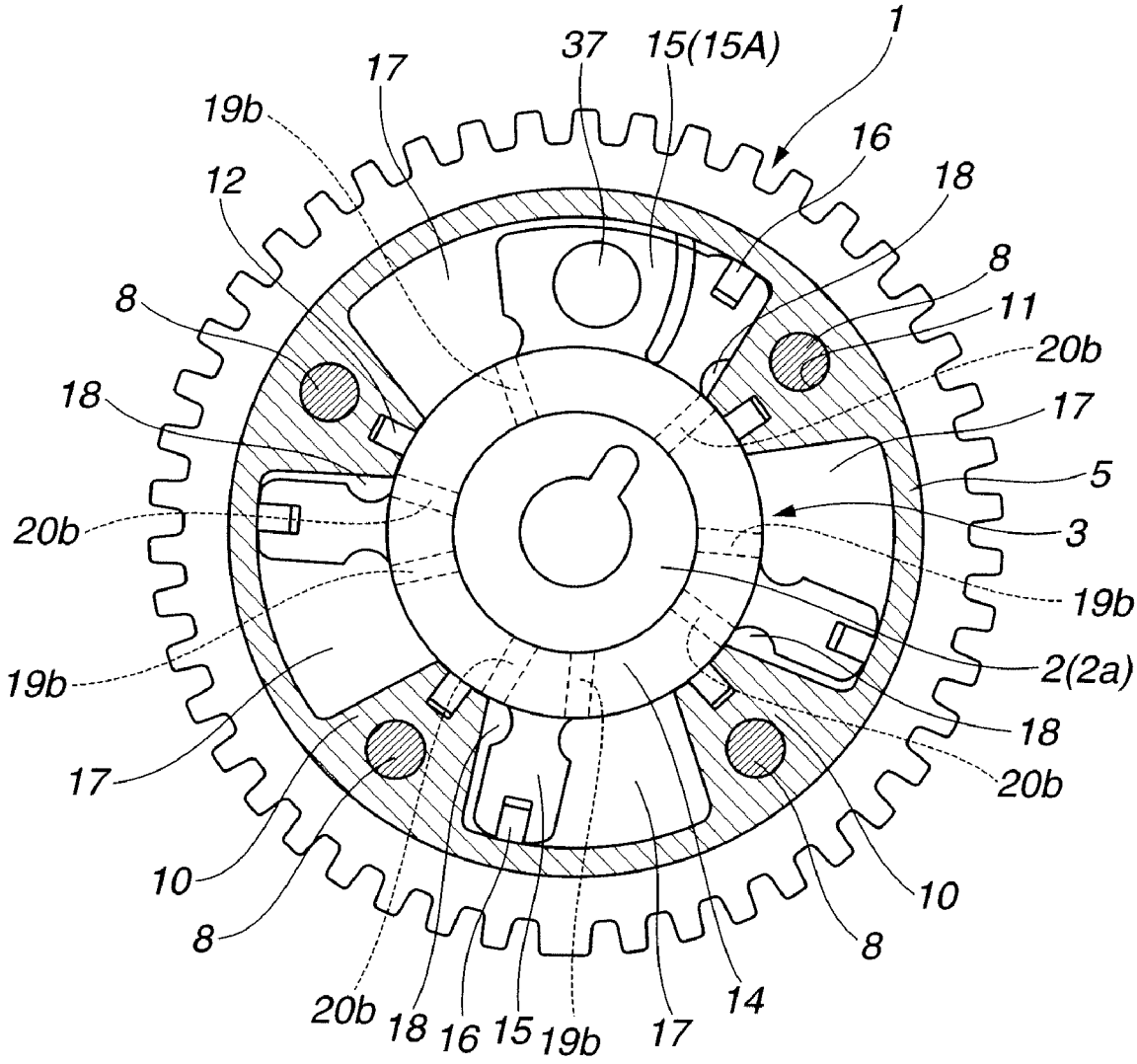
FIG. 3 is a cross-section of the valve timing control device of the embodiment, which shows a vane member placed in a maximum phase-advance position.

Housing 5 is formed into a hollow cylindrical shape and has opposed openings at front and rear ends thereof. As shown in FIG. 2, four partitions 10 are disposed on an inner circumferential surface of housing 5 at about 90° intervals in a circumferential direction of housing 5. Each of partitions 10 serves as a shoe and projects in a radially inward direction of housing 5. Partition 10 has a generally trapezoidal cross-section as shown in FIG. 2 and extends along an axial direction of housing 5. Partition 10 has opposed end surfaces which are located in the axial direction of housing 5 and in alignment with opposed annular peripheral surfaces surrounding the openings at the front and rear ends. Bolt insertion hole 11 extends through a central portion of partition 10 in the axial direction of housing 5 to receive bolt 8. Partition 10 further has an arcuately curved radial-inner surface that is configured to a shape corresponding to an outer circumferential surface of annular vane rotor 14 of vane member 3. Seal 12 and a plate spring, not shown, which presses seal 12 in a radially inward direction of housing 5 are fitted into and held in a groove that extends on the radial-inner surface of partition 10 in the axial direction of housing 5.

Front cover 6 has relatively large-diameter bolt insertion hole 6*a* that extends through a central portion of front cover 6. Front cover 6 further has four bolt holes in an outer circumferential portion thereof which are communicated with bolt insertion holes 11 of housing 5.

Rear cover 7 has bearing bore 7*a* at a substantially central portion thereof, in which front end portion 2*a* of camshaft 2 is rotatably supported. Rear cover 7 further has four female threaded holes in an outer circumferential portion thereof, into which small-diameter bolts 8 are screwed.

Camshaft 2 is rotatably supported on an upper end portion of a cylinder head through a cam bearing, not shown. Camshaft 2 includes integrally formed cams that are disposed in predetermined positions on an outer circumferential surface of camshaft 2 and act to open and close intake valves through valve lifters, not shown.

Vane member 3 is made of a sintered metal material and includes annular vane rotor 14 and four blades 15 which are integrally formed with vane member 3. Vane rotor 14 is located at a central portion of vane member 3 and fixed to front end portion 2*a* of camshaft 2 through cam bolt 13 in an axial direction thereof. Vane rotor 14 has central axial bore 14*a* through which cam bolt 13 extends, and fitting groove 14*b* into which front end portion 2*a* of camshaft 2 is fitted. Four blades 15 are disposed on the outer circumferential surface of vane rotor 14 at about 90° intervals in a circumferential direction of vane rotor 14 and project from the outer circumferential surface of vane rotor 14 in a radially outward direction of vane rotor 14.

As shown in FIG. 2, one blade 15A of four blades 15 is formed into a generally trapezoidal shape that has a largest width extending in the circumferential direction of vane rotor 14. The remaining three blades 15 are formed into an elongated rectangular shape having a width smaller than that of one blade 15A as shown in FIG. 2. These four blades 15 are located in predetermined angular positions in the circumferential direction of vane rotor 14 so that vane member 3 as a whole attains a balance in weight. Each of blades 15 is disposed between adjacent two partitions 10 and has a groove on an outer circumferential surface thereof. Seal 16 and plate spring 16*a* are fitted into the groove and retained therein as shown in FIG. 1. Seal 16 has a generally U-shape in cross-section as shown in FIG. 1 and comes into contact with an inner circumferential surface of housing 5. Plate spring 16*a* presses seal 16 against the inner circumferential surface of housing 5.

Each of blades 15 has side surfaces opposed to each other in the circumferential direction of rotor 14. Each of partitions 10 has side surfaces opposed to each other in the circumferential direction of housing 5. As shown in FIG. 2, phase-advance hydraulic chamber 17 is defined between one of the side surfaces of blade 15 and the side surface of partition 10 which is opposed to the one of the side surfaces of blade 15. Phase-retard hydraulic chamber 18 is defined between the other of the side surfaces of blade 15 and the side surface of partition 10 which is opposed to the other of the side surfaces of blade 15. In this embodiment, there are present four phase-advance hydraulic chambers 17 and four phase-retard hydraulic chambers 18.

As shown in FIG. 1, fluid pressure supply and discharge mechanism 4 includes two fluid passages, specifically, first fluid passage 19 and second fluid passage 20. First fluid passage 19 allows supply and discharge of a working fluid, namely, the lubricating oil, with respect to respective phase-advance hydraulic chambers 17. Second fluid passage 20 allows supply and discharge of the working fluid with respect to respective phase-retard hydraulic chambers 18. Supply passage 21 as a main oil gallery for supplying engine lubricating oil, and drain passage 22 are connected to first and second fluid passages 19 and 20 via directional control valve 23. Oil pump 25 is disposed in supply passage 21, which is a one-way variable displacement pump and pressurizes and feeds an oil in oil pan 24. Drain passage 22 has a downstream end that is communicated with oil pan 24.

As shown in FIG. 1 and FIG. 2, first fluid passage 19 is formed between directional control valve 23 and respective phase-advance hydraulic chambers 17. First fluid passage 19 includes first passage 19*a* that extends inside camshaft 2 in an axial direction of camshaft 2, and four first branch passages 19*b* that communicate first passage 19*a* with respective phase-advance hydraulic chambers 17. First passage 19*a* extends from the cylinder head into camshaft 2 through the cam bearing. First branch passages 19*b* are branched from a circumferential groove at front end portion 2*a* of camshaft 2 into vane rotor 14 in a substantially radial direction of camshaft 2 and opened to respective phase-advance hydraulic chambers 17.

On the other hand, second fluid passage 20 is formed between directional control valve 23 and respective phase-retard hydraulic chambers 18. Second fluid passage 20 includes second passage 20*a* that extends inside camshaft 2 in the axial direction of camshaft 2, and four second branch passages 20*b* that communicate second passage 20*a* with respective phase-retard hydraulic chambers 18. Second passage 20*a* extends from the cylinder head into camshaft 2 through the cam bearing. Second branch passages 20*b* are branched from a circumferential groove at front end portion 2*a* of camshaft 2 into vane rotor 14 in a substantially radial direction of camshaft 2 and opened to respective phase-retard hydraulic chambers 18.

Vane member 3, housing 5, phase-advance hydraulic chambers 17, phase-retard hydraulic chambers 18 and fluid pressure supply and discharge mechanism 4 constitute a phase varying mechanism.

As shown in FIG. 1, directional control valve 23 is a four-port, two-position solenoid-operated valve and disposed within the cylinder head. Directional control valve 23 includes hollow cylindrical valve casing 27 fixed into valve bore 26 that is formed in the cylinder head. Directional control valve 23 further includes solenoid 28 fixed to one end portion of valve casing 27, and spool valve body 29 that is slidable in valve casing 27.

Valve casing 27 includes supply port 30 that is formed in a substantially middle position in an axial direction of valve casing 27. Supply port 30 extends through valve casing 27 in a radial direction of valve casing 27 and allows fluid communication between an inside of valve casing 27 and supply passage 21. Valve casing 27 further includes first port 31 and second port 32 which are formed on both sides of supply port 30 in the axial direction of valve casing 27. First and second ports 31 and 32 extend through valve casing 27 in the radial direction of valve casing 27 and allow fluid communication between the inside of valve casing 27 and an end portion of first fluid passage 19 and fluid communication between the inside of valve casing 27 and an end portion of second fluid passage 20, respectively. Valve casing 27 further includes first drain port 33 and second drain port 34 which are formed apart from first port 31 and second port 32 on both sides of supply port 30, respectively. That is, first port 31 is disposed between first drain port 33 and supply port 30 in the axial direction of valve casing 27, and second port 32 is disposed between second drain port 34 and supply port 30 in the axial direction of valve casing 27. First and second drain ports 33 and 34 extend through valve casing 27 in the radial direction of valve casing 27 and allow fluid communication between the inside of valve casing 27 and drain passage 22.

Solenoid 28 includes solenoid casing 28*a*, electromagnetic coil 28*b* disposed within solenoid casing 28*a*, stator core 28*c* that is excited by energizing electromagnetic coil 28*b*, and moveable plunger 28*d* that is slidably moved in solenoid casing 28*a* and urges spool valve body 29 upon excitation of stator core 28*c*. Electromagnetic coil 28*b* is connected to electronic controller 36 via a harness, not shown.

Spool valve body 29 includes first land 29*a* disposed at a substantially middle portion of spool valve body 29 in an axial direction of spool valve body 29, second land 29*c* and third land 29*b* which are disposed on both sides of first land 29*a* in the axial direction of spool valve body 29. First land 29*a*, second land 29*c* and third land 29*b* are arranged to open and close ports 30, 31 and 32 and drain ports 33 and 34 depending on a sliding position of spool valve body 29 in the axial direction. First land 29*a* opens and closes supply port 30. Second land 29*c* opens and closes first port 31 and first drain port 33. Third land 29*b* opens and closes second port 32 and second drain port 34. Return spring 35 is installed between an axial end surface of second land 29*c* and spring retainer 27*a* on a side of the other end portion of valve casing 27. Spool valve body 29 is biased toward a most leftward position by a spring force of return spring 35 in which fluid communication between supply port 30 and second port 32 is established and fluid communication between first port 31 and first drain port 33 is established. Spool valve body 29 is moveable against the spring force of return spring 35 toward a most rightward position or a predetermined intermediate position between the most leftward position and the most rightward position in the axial direction of valve casing 27 in response to a control current (or a control signal) from electronic controller 36.

Electronic controller 36 receives input information from various engine/vehicle sensors, namely a crank angle sensor for detecting engine speed, an airflow meter for detecting intake air quantity, an engine temperature sensor (an engine coolant temperature sensor), and a throttle opening sensor. Electronic controller 36 determines an operating condition of the engine on the basis of the input information from the engine/vehicle sensors. Electronic controller 36 further conducts changeover of fluid passages 19 and 20 by energizing electromagnetic coil 28*a* of directional control valve 23 with a pulse control current or de-energizing electromagnetic coil 28*a* in accordance with the operating condition of the engine. Electronic controller 36 may be a microcomputer including an input/output interface (I/O), memories (RAM, ROM), and a microprocessor or a central processing unit (CPU).

As shown in FIG. 1, lock mechanism 37 is disposed between housing 5 of timing sprocket 1 and one blade 15A that has the largest width. Lock mechanism 37 acts to restrain the rotation of vane member 3 with respect to housing 5 and release vane member 3 from the restraint.

Figure 4:
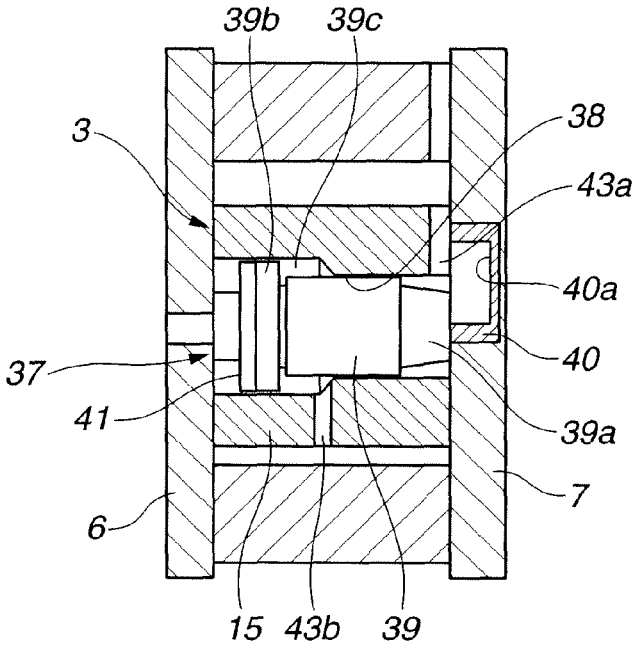
FIG. 4 is a cross-section of a lock mechanism for the vane member which is used in the valve timing control device of the embodiment.

Specifically, as shown in FIG. 1 and FIG. 4, lock mechanism 37 is disposed in one blade 15A having the largest width and rear cover 7. Lock mechanism 37 includes slide bore 38 extending through one blade 15A in the axial direction of camshaft 2, hollow cylindrical lock piston 39 slidably disposed within slide bore 38, cup-shaped engaging member 40 with lock hole 40*a* which is fixed to rear cover 7, and coil spring 42 that is disposed inside lock piston 39 and biases lock piston 39 toward lock hole 40*a*. Coil spring 42 has one end supported by spring retainer 41 that is fixedly disposed on a side of a bottom of slide bore 38, and an opposite end fixedly disposed on a side of a closed end of lock piston 39.

As shown in FIG. 4, lock piston 39 includes tapered tip end portion 39*a* and large-diameter flange 39*b* integrally formed with the other end portion that is opposed to tapered end portion 39*a*. Lock hole 40*a* of engaging member 40 is configured to be engageable with tapered end portion 39*a* of lock piston 39. Lock piston 39 is disposed to be moveable in an axial direction thereof, namely, in an axial direction of slide bore 38, such that tapered end portion 39*a* is engaged with lock hole 40*a* and disengaged from lock hole 40*a*. Tapered end portion 39*a* of lock piston 39 is brought into engagement with lock hole 40*a* by a spring force of coil spring 42 when vane member 3 is placed in a maximum phase-retard position in which relative rotation between timing sprocket 1 and camshaft 2 is restrained.

Pressure-receiving chamber 39*c* is formed between large-diameter flange 39*b* and a step portion of slide bore 38 which is disposed between a large-diameter bore and a small-diameter bore of slide bore 38. Lock piston 39 is moveable in slide bore 38 to be retreated and disengaged from lock hole 40*a* against the spring force of coil spring 42 by either of a fluid pressure that is supplied from phase-advance hydraulic chamber 17 into lock hole 40*a* through first oil hole 43*a* formed in vane member 3, and a fluid pressure that is supplied from phase-retard hydraulic chamber 18 to pressure-receiving chamber 39*c* through second oil hole 43*b* formed in vane member 3.

Coil spring 42 acts as a lock condition maintaining member and has the spring force that is set so as to prevent coil spring 42 from being excessively compressed and deformed by a pressure of air within respective phase-retard hydraulic chambers 18 which is compressed by a pressurized fluid fed from oil pump 25 at start-up of the engine.

Figure 5:
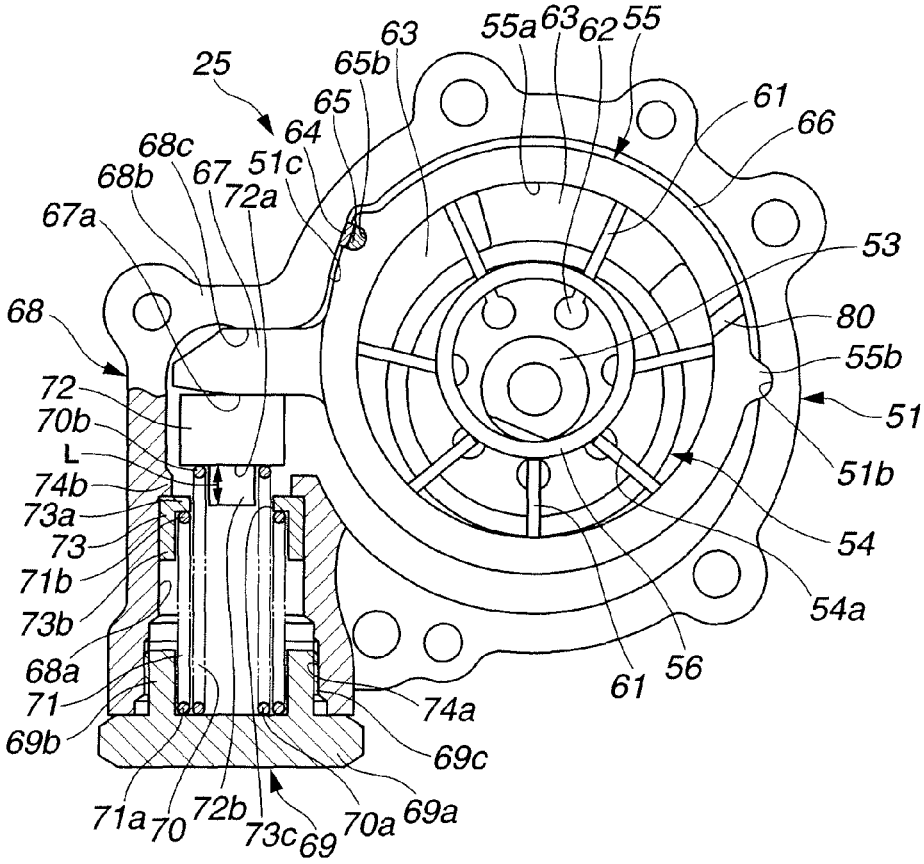
FIG. 5 is a front view of a variable displacement pump used in the valve timing control device of the embodiment, which is shown partly in cross-section.
Figure 6:
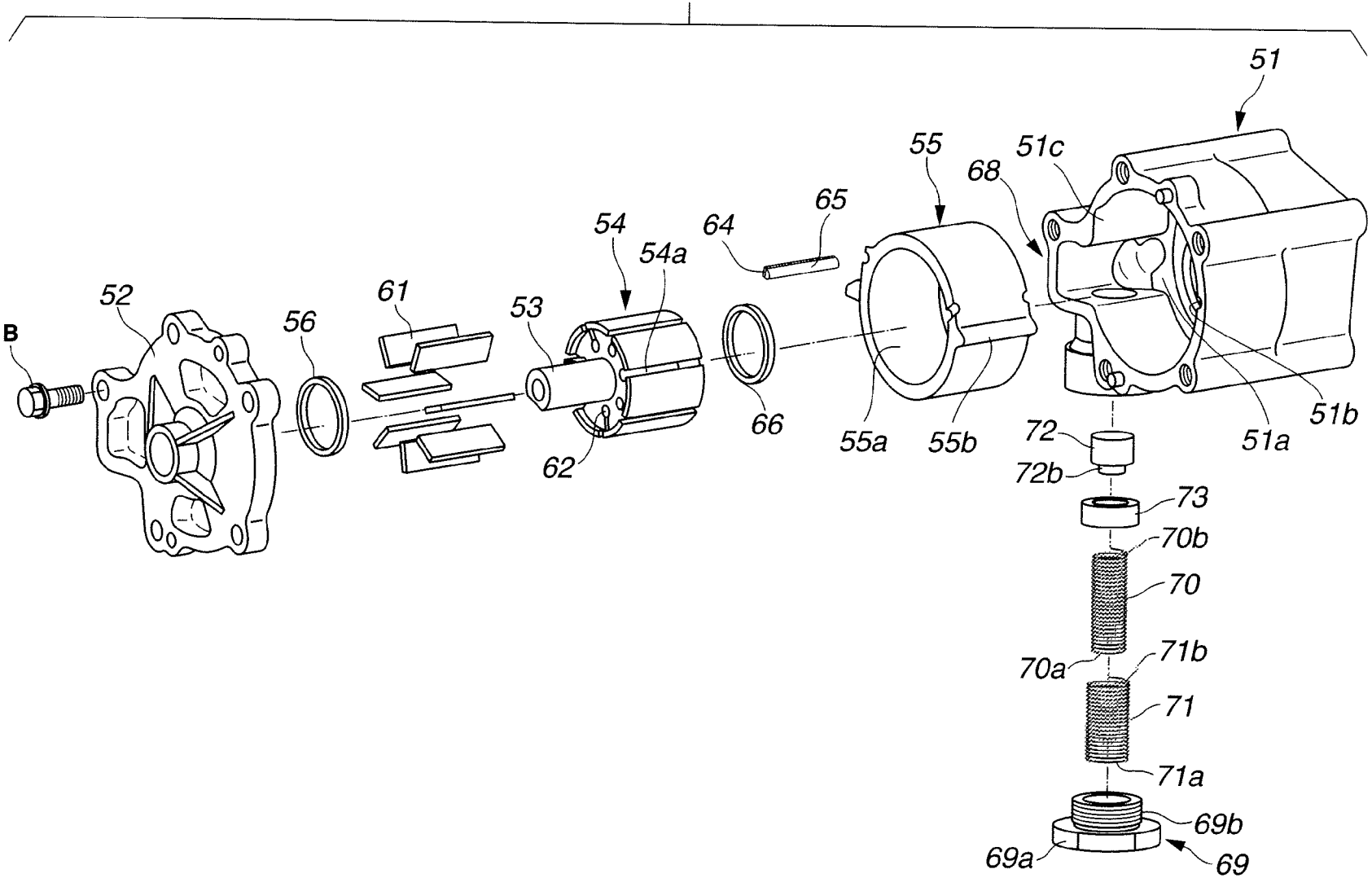
FIG. 6 is an exploded perspective view of the variable displacement pump shown in FIG. 5.

A specific construction of oil pump 25 will be explained hereinafter. Oil pump 25 is disposed at a front end portion of the cylinder head of the engine. As shown in FIG. 5 and FIG. 6, oil pump 25 as a pump unit includes hollow cylindrical pump housing 51 with an open end, cover 52 closing the open end of pump housing 51, driving shaft 53 that extends through pump housing 51 substantially in a direction of an central axis of pump housing 51 and is driven by the crankshaft of the engine. Oil pump 25 further includes cylindrical rotor 54 rotatably disposed within pump housing 51, cam ring 55 swingably disposed on a radial outside of rotor 54, and a pair of vane rings 56, 56 that have a diameter smaller than rotor 54 and are slidably disposed on opposed axial end surfaces of rotor 54. Rotor 54 is connected at a central portion thereof to driving shaft 53.

Figure 7:
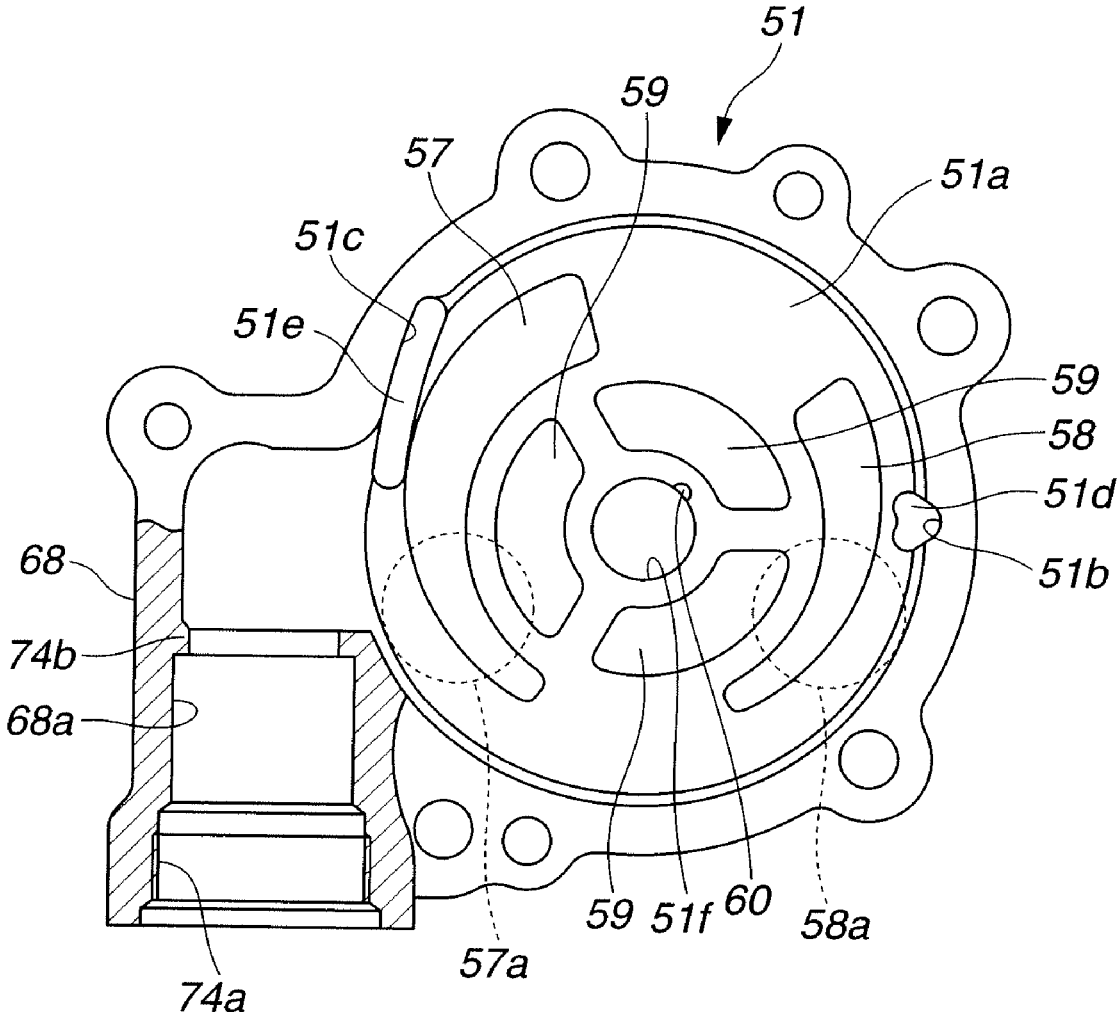
FIG. 7 is a front view of a pump housing of the variable displacement pump shown in FIG. 5.

Pump housing 51 is made of an aluminum alloy material. Pump housing 51 includes generally circular bottom surface 51*a* shown in FIG. 7 which comes into slide-contact with an annular axial end surface of cam ring 55. Bottom surface 51*a* is machined with high accuracy in flatness and surface roughness. As shown in FIG. 5 to FIG. 7, pump housing 51 further includes pivot seat 51*b* that is formed in a predetermined position on an inner circumferential surface of pump housing 51. Pivot seat 51*b* supports pivot portion 55*b* of cam ring 55 so as to allow an eccentric swing movement of cam ring 55 relative to rotor 54. Pivot seat 51*b* is provided in the form of a grooved portion that has a generally arcuate curved surface. Pump housing 51 further includes seal sliding surface 51*c* that is formed on the inner circumferential surface of pump housing 51 and substantially opposed to pivot seat 51*b* in a diametrical direction of pump housing 51. Seal sliding surface 51*c* is provided for slide-contact with seal 64 of cam ring 55 and formed into an arcuate curved surface that has a center of curvature at pivot seat 51*b*.

Since pivot seat 51*b* and seal sliding surface 51*c* have a small R, respectively, pivot seat 51*b* and seal sliding surface 51*c* can be formed using relatively small tools. This serves for reduction of machining time. Further, when machining pivot seat 51*b* and seal sliding surface 51*c*, generally heart-shaped fine recess 51*d* and elongated fine recess 51*e* are formed on a side of bottom surface 51*a* as machining marks as shown in FIG. 7. With the formation of fine recesses 51*d* and 51*e*, cam ring 55 enables a smooth swing movement without being adversely influenced.

As shown in FIG. 7, bottom surface 51*a* further includes generally crescent-shaped suction port 57 on a side of seal sliding surface 51*c* and generally crescent-shaped discharge port 58 on a side of pivot seat 51*b*. Suction port 57 and discharge port 58 are arranged about a center of bottom surface 51*a* in substantially diametrically opposed relation to each other. Suction port 57 is communicated with suction inlet 57*a* indicated by broken line in FIG. 7, from which the lubricating oil within an oil pan, not shown, is sucked. Discharge port 58 is communicated with discharge outlet 58*a* indicated by broken line in FIG. 7, from which the lubricating oil is discharged and fed to the sliding portions of the engine and the valve timing control device via the main oil gallery to thereby ensure lubrication.

Bearing bore 51*f* is formed at the center of bottom surface 51*a*, into which driving shaft 53 is received. Three oil sump portions 59 are arranged on a radial outside of bearing bore 51*f* in an equidistantly spaced relation to each other in a circumferential direction of bottom surface 51*a*. Each of oil sump portions 59 acts to provisionally reserve the lubricating oil that is discharged from discharge port 58. The lubricating oil is fed from oil sump portions 59 to bearing bore 51*f* through bearing lubricating groove 60 and supplied to the opposed axial end surfaces of rotor 54 and opposed surfaces of vanes 61 on rotor 54 as explained later.

In this embodiment, cover 52 has a flat axial-inner surface that is directed to the open end of pump housing 51. Cover 52 may be formed with a suction inlet, a discharge outlet and oil sump portions similar to bottom surface 51*a* of pump housing 51. Cover 52 is secured to pump housing 51 by means of bolts B as shown in FIG. 6.

Driving shaft 53 is operated to rotate rotor 54 in a clockwise direction in FIG. 5 by the rotational force that is transmitted from the crankshaft of the engine. In FIG. 5, a left half corresponds to a suction stroke and a right half corresponds to a discharge stroke.

As shown in FIG. 5 and FIG. 6, rotor 54 includes a plurality of slits 54*a* that extend from an inside of rotor 54 toward an outside thereof in a radial direction of rotor 54 and are arranged to be spaced apart from each other in a circumferential direction of rotor 54. A plurality of vanes 61 are slidably retained in slits 54*a* so as to project from slits 54*a* and retract into slits 54*a* in the radial direction of rotor 54 and define a plurality of pump chambers 63, namely, working chambers, by projecting from slits 54*a*. Back pressure chamber 62 is formed at a radial-inner end of each of slits 54*a*, into which a pressure fluid discharged to discharge port 58 is introduced. Back pressure chamber 62 has a generally circular shape in cross-section.

Each of vanes 61 has a radial-inner end that is slidably contacted with an outer circumferential surface of each of vane rings 56 and a radial-outer end that is slidably contacted with inner circumferential surface 55*a* of cam ring 55. Each of pump chambers 63 is hermetically defined between side surfaces of vane 61 which are opposed to each other in the circumferential direction of rotor 54, inner circumferential surface 55*a* of cam ring 55, an outer circumferential surface of rotor 54, bottom surface 51*a* of pump housing 51, and the axial-inner surface of cover 52. Vane rings 56 act to push vanes 61 in a radially outward direction thereof, respectively.

Cam ring 55 is made of a suitable sintered metal material that can be easily worked, and formed into a generally cylindrical shape. Cam ring 55 includes pivot portion 55*b* that is located in a predetermined position on an outer circumferential surface of cam ring 55 and integrally formed with cam ring 55. Pivot portion 55*b* is in the form of a projection that outwardly projects from the outer circumferential surface of cam ring 55 and has an arcuate cross-section shown in FIG. 5. Pivot portion 55*b* extends in an axial direction of cam ring 55. Pivot portion 55*b* is engaged in pivot seat 51*b* of pump housing 51 and serves as a fulcrum of the eccentric swing movement of cam ring 55 relative to rotor 54. Cam ring 55 further includes seal 64 that is located in the position substantially diametrically opposed to pivot portion 55*b* on the outer circumferential surface of cam ring 55 and brought into slide-contact with seal sliding surface 51*c* of pump housing 51 upon the eccentric swing movement of cam ring 55.

Seal 64 is made of a suitable synthetic resin material, for instance, a low-abrasion synthetic resin, and formed into a strip elongated in the axial direction of cam ring 55. Seal 64 is urged by an elastic force of elastic member 65 to press against seal sliding surface 51*c*. Elastic member 65 is fixed into retention groove 65*b* that is formed on the outer circumferential surface of cam ring 55 so as to have an arcuate cross-section shown in FIG. 5. With this arrangement of elastic member 65, control fluid chamber 66 as explained later can be always held in good hermeticity.

Control fluid chamber 66 is defined between the outer circumferential surface of cam ring 55, pivot portion 55*b*, seal 64 and the inner circumferential surface of pump housing 51. Control fluid chamber 66 has a generally crescent-shape as shown in FIG. 5. Discharge fluid pressure introducing passage 80 is formed on a front end surface of cam ring 55, through which the pressurized fluid discharged from discharge port 58 is introduced into control fluid chamber 66. That is, the pressure of the fluid discharged from discharge port 58, hereinafter referred to as discharge fluid pressure, is introduced into control fluid chamber 66. Cam ring 55 is allowed to swing about pivot portion 55*b* as the fulcrum in a counterclockwise direction in FIG. 5 by the discharge fluid pressure introduced into control fluid chamber 66 through discharge fluid pressure introducing passage 80. This results in reduction in an eccentric amount of a central axis of cam ring 55 with respect to a central axis of rotor 54, causing cam ring 55 to move toward a concentric position relative to rotor 54. Discharge fluid pressure introducing passage 80 may be formed to extend through a circumferential wall of cam ring 55.

Cam ring 55 further includes arm 67 that is located in a position diametrically opposed to pivot portion 55*b* on the outer circumferential surface of cam ring 55 and integrally formed with cam ring 55. Arm 67 radially outwardly projects from the outer circumferential surface of cam ring 55. Arm 67 has curved surface 67*a* on a side of a tip end thereof, namely, on a lower side when viewed in FIG. 5. Curved surface 67*a* has an arc-shaped cross section as shown in FIG. 5.

Thus, oil pump 25 as the pump unit is constituted of pump housing 51, driving shaft 53, rotor 54, cam ring 55, suction port 57, discharge 58, vanes 61 and other parts as described above.

As shown in FIG. 5, pump housing 51 further includes cylinder body 68 that is formed on an opposite side of pivot seat 51*b*. Cylinder body 68 is formed into a cylindrical shape having an open end. The open end of cylinder body 68 is closed by plug 69. Cylinder body 68 accommodates inner coil spring 70 as a first biasing member and outer coil spring 71 as a second biasing member. Inner and outer coil springs 70 and 71 always bias cam ring 55 through arm 67 toward such a direction that the eccentric amount of the central axis of cam ring 55 relative to the central axis of rotor 54 becomes a maximum.

Inner and outer coil springs 70 and 71 are arranged in an internal space of cylinder body 68 in parallel with each other. That is, inner coil spring 70 is located on a radial inside of outer coil spring 71. First plunger 72 is disposed between upper end portion 70*b* of inner coil spring 70 and curved surface 67*a* of arm of cam ring 55. First plunger 72 serves as a press member that urges arm 67. Second plunger 73 is disposed between outer coil spring 71 and inner circumferential surface 68*a* of cylinder body 68 to rest on upper end portion 71*b* of outer coil spring 71. Second plunger 73 is slidable on inner circumferential surface 68*a* of cylinder body 68 and guided therealong.

Cylinder body 68 has a three-step structure on inner circumferential surface 68*a* in which an inner diameter of cylinder body 68 is stepwisely decreased upwardly from the lower open end. Internal thread 74*a* is formed on inner circumferential surface 68*a* at a large-diameter portion of cylinder body 68 which is located on a side of the lower open end. Internal thread 74*a* is meshed with external thread 69*c* formed on an outer circumferential surface of plug 69. Annular stop 74*b* is formed on inner circumferential surface 68*a* of cylinder body 68 at a boundary between an intermediate-diameter portion located above the large-diameter portion, and a small-diameter portion of cylinder body 68 located above the intermediate-diameter portion. Cylinder body 68 includes upper wall 68*b* having lower surface 68*c* that is brought into contact with an upper surface of arm 67 when arm 67 is rotated in the clockwise direction in FIG. 5 by the spring forces of inner and outer coil springs 70 and 71. Owing to the contact between lower surface 68*c* of upper wall 68*b* and the upper surface of arm 67, cam ring 55 can be restrained in the maximum eccentric position.

Plug 69 includes generally disk-shaped lid 69*a* disposed on a lower end portion of plug 69, and cylindrical portion 69*b* that is integrally formed with lid 69*a* so as to project from an upper surface of lid 69*a*. Cylindrical portion 69*b* is exposed to the internal space of cylinder body 68 through the lower open end of cylinder body 68. Cylindrical portion 69*b* has external thread 69*c* on the outer circumferential surface thereof. An amount of screwing plug 69 into the large-diameter portion of cylinder body 68 can be adjusted until the upper surface of lid 69*a* abuts on the lower open end of cylinder body 68. When the upper surface of lid 69*a* abuts on the lower open end of cylinder body 68, the amount of screwing plug 69 becomes a maximum. Thus, the amount of screwing plug 69 can be limited by abutment of lid 69*a* of plug 69 with the lower open end of cylinder body 68.

Inner coil spring 70 has an inner diameter smaller than that of outer coil spring 71 and a length larger than that of outer coil spring 71. Lower end portion 70*a* of inner coil spring 70 is supported on the upper surface of lid 69*a* in contact therewith, and upper end portion 70*b* of inner coil spring 70 is supported on lower surface 72*a* of first plunger 72 in contact therewith. Inner coil spring 70 has predetermined set load W1 at which cam ring 55 is allowed to start movement when the fluid pressure reaches fluid pressure P1 necessary for operating a variable valve operating apparatus of the engine.

In this embodiment, first plunger 72 is formed into a solid and stepped cylindrical shape. First plunger 72 may be hollowed in order to reduce the weight. First plunger 72 includes a cylindrical base portion having lower surface 72*a*, and cylindrical projection 72*b* projecting downwardly from a central portion of lower surface 72*a*. Projection 72*b* has a diameter smaller than that of the base portion and is integrally formed with the base portion. The base portion has a flat upper surface that is always in contact with lower surface 67*a* of arm 67. Projection 72*b* retains upper end portion 70*b* of inner coil spring 70 by engagement therewith. Projection 72*b* has such axial length L as to extend through spring insertion hole 73*c* that is formed in upper wall 73*a* of second plunger 73, when first plunger 72 is arranged between upper end portion 70*b* of inner coil spring 70 and arm 67 of cam ring 55. With the provision of projection 72*b* having the axial length L, inner coil spring 70 can be prevented from inclining or twisting when inner coil spring 70 is deformed into a compressed or expanded state. This serves for ensuring always smooth deformation of inner coil spring 70.

Outer coil spring 71 includes lower end portion 71*a* that is supported on the upper surface of lid 69*a* of plug 69 in contact therewith, and upper end portion 71*b* that is supported on a lower surface of upper wall 73*a* of second plunger 73 in contact therewith. Outer coil spring 71 has predetermined set load W2 at which cam ring 55 is allowed to start movement when the fluid pressure reaches fluid pressure P2 necessary for a maximum speed of the crankshaft.

Inner coil spring 70 and outer coil spring 71 are wound in opposite winding directions. Inner coil spring 70 and outer coil spring 71, therefore, can be prevented from meshing with each other during deformation owing to the compression and expansion, serving for always attaining smooth deformation thereof.

Second plunger 73 is made of an iron-based metal material and formed into a cylindrical shape having a generally reversed U-shaped cross-section. Second plunger 73 includes upper wall 73*a* with spring insertion hole 73*c*, and cylindrical side wall 73*b* that extends from an outer circumferential portion of the lower surface of upper wall 73*a*. Spring insertion hole 73*c* penetrates a central portion of upper wall 73*a*, through which inner coil spring 70 extends between first plunger 72 and plug 69. Spring insertion hole 73*c* has an inner diameter smaller than an outer diameter of first plunger 72. The inner diameter of spring insertion hole 73*c* is set such that a circumferential peripheral edge of spring insertion hole 73*c* can be prevented from being contacted with an outer circumferential surface of inner coil spring 70 even when inner coil spring 70 is in the compressed state. With the construction of spring insertion hole 73*c*, when first plunger 72 is urged to downwardly move to a predetermined position by arm 67 of cam ring 55, lower surface 72*a* of first plunger 72 comes into contact with an inner circumferential portion of an upper surface of upper wall 73*a* which surrounds spring insertion hole 73*c*.

Second plunger 73 is moveable within the internal space of cylinder body 68 in an up-and-down direction, namely, in an axial direction of second plunger 73, while being guided along inner circumferential surface 68*a* of cylinder body 68 in slide-contact therewith. When second plunger 73 is moved to an upper-most position, an outer circumferential portion of the upper surface of upper wall 73*a* is contacted with stop 74*b* on inner circumferential surface 68*a* of cylinder body 68. Owing to the contact between upper wall 73*a* and stop 74*b*, second plunger 73 can be prevented from being displaced beyond the upper-most position.

Adjusting members that are different in thickness from each other may be respectively used as a spacer. In such a case, a suitable one of the adjusting members is selected and disposed between lid 69*a* of plug 69 and the lower open end of cylinder body 68, so that the amount of screwing plug 69 into cylinder body 68 can be adjusted to thereby freely modify the spring forces of inner and outer coil springs 70 and 71.

In the above-described construction, the eccentric amount of the central axis of cam ring 55 relative to the central axis of rotor 54 is varied depending on a relative pressure (differential pressure) between the spring forces of inner and outer coil springs 70 and 71 and the discharge fluid pressure in control fluid chamber 66. Volumetric change of pump chambers 63 can be caused depending on the eccentric amount of the central axis of cam ring 55 relative to the central axis of rotor 54, resulting in variation in discharge fluid pressure that is discharged from suction port 57 to discharge port 58 via pump chambers 63.

Cam ring 55, vane rings 56, control fluid chamber 66, inner and outer coil springs 70, 71 and other parts as described above constitute a variable displacement mechanism for varying the volumes of pump chambers 63 by displacing cam ring 55. Cam ring 55 serves as a moveable member of the variable displacement mechanism.

Figure 10:
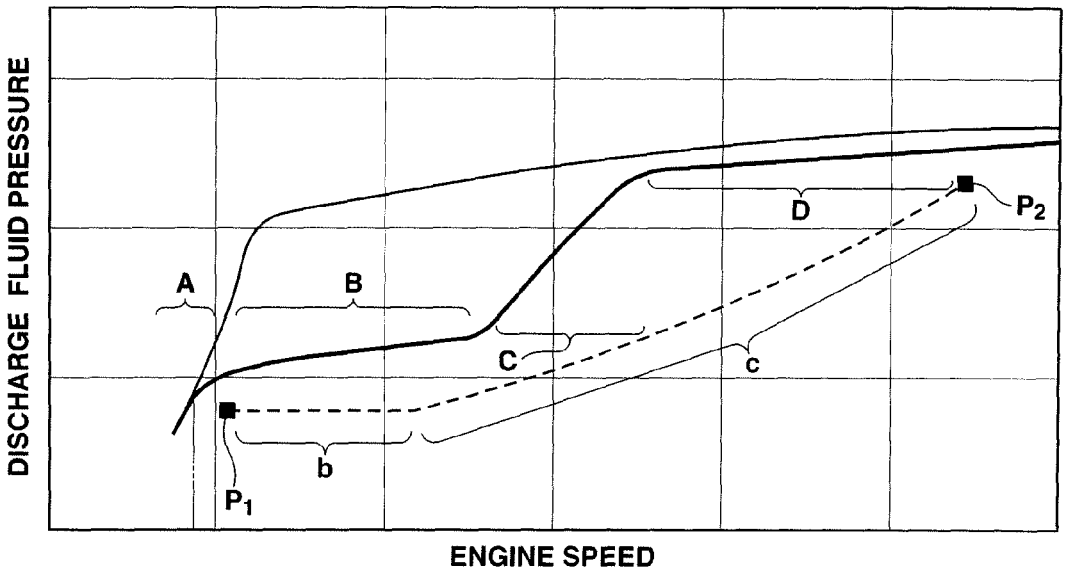
FIG. 10 is a graph showing a relationship between a discharge fluid pressure and an engine speed.

Referring to FIG. 10, there are shown characteristic curves of a fluid pressure that is discharged by the conventional variable displacement pump using a single coil spring, a fluid pressure that is discharged by oil pump 25 of the embodiment of the invention, and a reference discharge fluid pressure necessary for lubrication of the engine slide parts and operation of the valve timing control device. In FIG. 10, a thick solid line, a thin solid line and a broken line indicate the characteristic curves of the fluid pressure that is discharged by the conventional variable displacement pump, the fluid pressure that is discharged by oil pump 25, and the reference discharge fluid pressure, respectively.

A fluid pressure necessary for an internal combustion engine is determined substantially on the basis of a fluid pressure that is necessary for lubricating bearings of the crankshaft. As indicated by the broken line in FIG. 10, the reference discharge fluid pressure increases as the engine speed rises. In order to satisfy the fluid pressure necessary for lubricating the slide parts in all regions of the engine speed, a discharge fluid pressure that controls the cam ring so as to start displacement is set at fluid pressure P2 that is necessary for lubricating the slide parts at a maximum engine speed.

Further, when the fluid pressure is also used for operating the valve timing control device in order to enhance fuel economy and exhaust emission, relatively high fluid pressure P1 at portion b of the broken line in FIG. 10 is required to improve an operating response of the valve timing control device in a low-speed region that corresponds to portion b of the broken line. Accordingly, the fluid pressure necessary for the entire engine in all regions of the engine speed has the characteristic curve indicated by the broken line in FIG. 10 which extends between fluid pressure P1 and fluid pressure P2 and includes portion b and portion c.

However, in the conventional variable displacement pump, the cam ring is biased in such a direction as to have the maximum eccentric amount of the central axis of the cam ring relative to the central axis of rotor 54 only by the single coil spring having a constant set load. In this case, the discharge fluid pressure as a control fluid pressure has the characteristic curve indicated by the thin solid line in FIG. 10 which abruptly raises in the low-speed region and gradually rises along with increase in the engine speed. That is, in the case of the conventional variable displacement pump, the discharge fluid pressure becomes larger than necessary, thereby causing a large power loss that starts from the low-speed region.

In contrast, in the embodiment of the invention, the discharge fluid pressure has the characteristic curve indicated by the thick solid line in FIG. 10. Specifically, at engine start-up, as shown in FIG. 5, arm 65 of cam ring 55 is urged to press against lower surface 68*c* of upper wall 68*b* of cylinder body 68 by the spring force of inner coil spring 70 so that cam ring 55 is in a stopped state. At this time, the eccentric amount of the central axis of cam ring 55 relative to the central axis of rotor 54 is the maximum and a pump discharge flow is the largest. As the engine speed increases, the discharge fluid pressure rapidly raises as shown at a portion of the characteristic curve indicated by the thick solid line in FIG. 10 which is located in region A.

Figure 8:
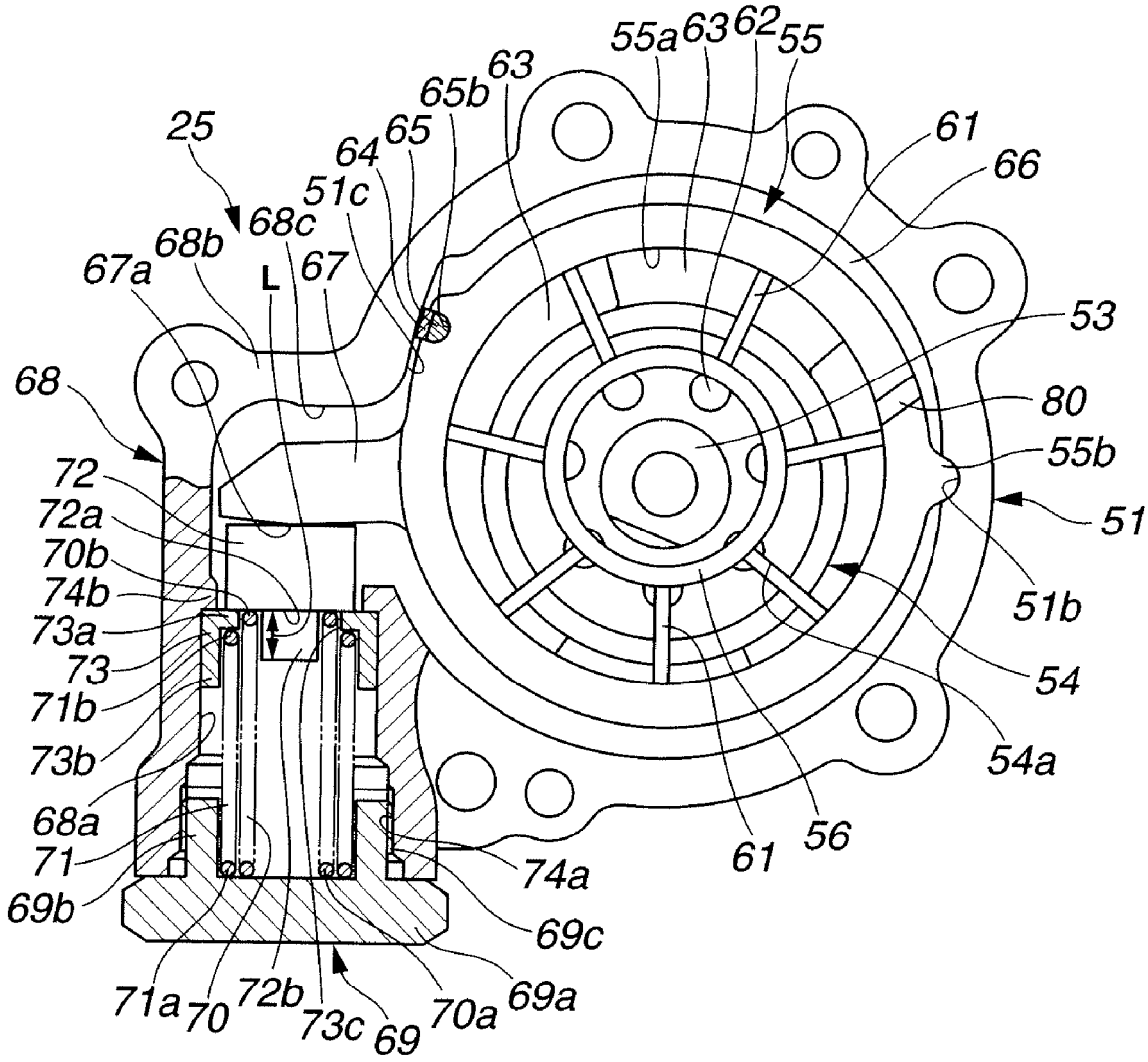
FIG. 8 is an explanatory diagram showing an operating state of the variable displacement pump shown in FIG. 5.

When the discharge fluid pressure reaches fluid pressure P1 in FIG. 10 along with the increase in engine speed, the fluid pressure introduced in control fluid chamber 66 becomes large to urge cam ring 55 to compressively deform inner coil spring 70 that acts on arm 67 and allow cam ring 55 to swing about pivot portion 55*b* in the counterclockwise direction in eccentric relation to rotor 54. As a result, the pump volume is reduced and the rise in the discharge fluid pressure becomes small as shown at a portion of the characteristic curve indicated by the thick solid line in FIG. 10 which is located in region B. Subsequently, cam ring 55 is allowed to further swing in the counterclockwise direction until lower surface 72*a* of first plunger 72 abuts on the inner circumferential portion of the upper surface of upper wall 73*a* of second plunger 73 which surrounds spring insertion hole 73*c*. Cam ring 55 is thus moved from the position shown in FIG. 5 to the position shown in FIG. 8. From this moment at which first plunger 72 is in contact with second plunger 73 as shown in FIG. 8, set load W2 of outer coil spring 71 is applied to cam ring 55 through arm 67 in addition to set load W1 of inner coil spring 70. Cam ring 55 is prevented from causing the swing movement and held in the state shown in FIG. 8 until the discharge fluid pressure reaches fluid pressure P2 (fluid pressure P2 in control fluid chamber 66) and exceeds set load W2. The discharge fluid pressure rises as shown at a portion of the characteristic curve indicated by the thick solid line in FIG. 10 which is located in region C. In this state, the eccentric amount of the central axis of cam ring 55 relative to the central axis of rotor 54 becomes small and the pump volume is reduced. The portion of the characteristic curve which is located in region C has a gradual slope as compared to a steep slope of the portion of the characteristic curve which is located in region A.

Figure 9:
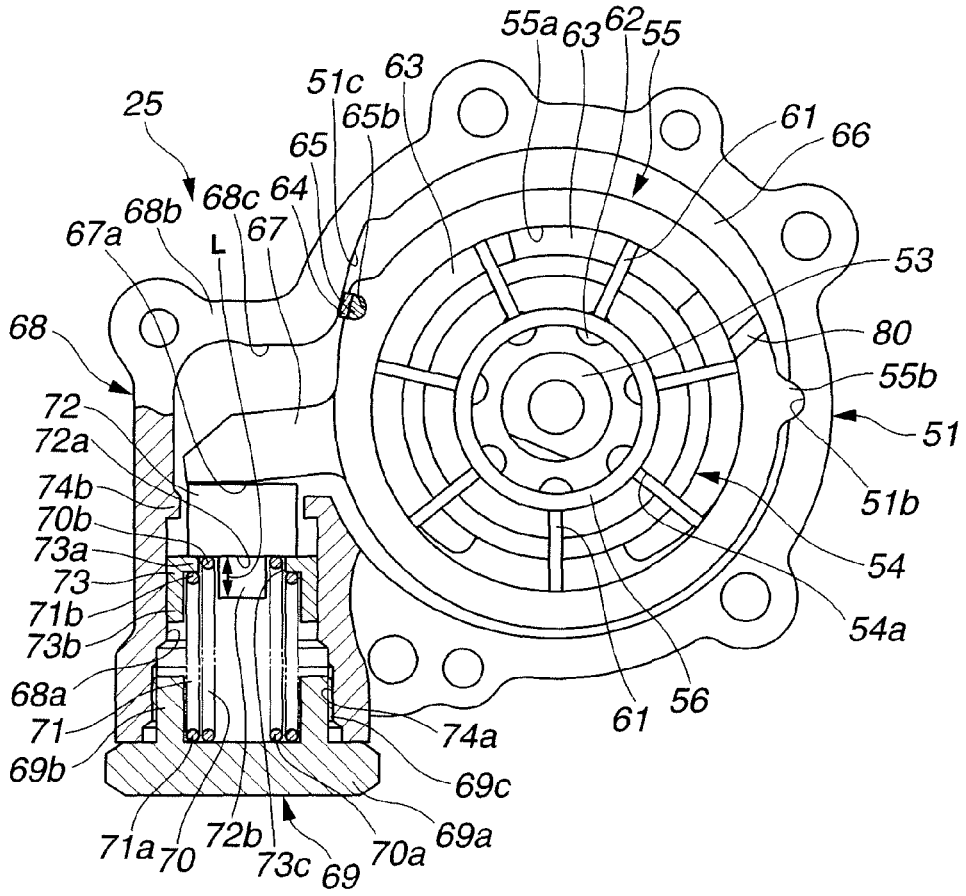
FIG. 9 is an explanatory diagram showing an operating state of the variable displacement pump shown in FIG. 5.

When the discharge fluid pressure exceeds fluid pressure P2 as the engine speed further increases as shown in FIG. 10, cam ring 55 is allowed to further swing in the counterclockwise direction and move from the position shown in FIG. 8 to the position shown in FIG. 9 while compressively deforming both inner coil spring 70 and outer coil spring 71 against set load W2 of outer coil spring 71 through arm 67. The pump volume is further reduced along with the swing movement of cam ring 55, so that the increase in the discharge fluid pressure becomes small. The discharge fluid pressure is kept with the small slope as shown in a portion of the characteristic curve indicated by the thick solid line in FIG. 10 which is located in region D, until the engine speed reaches the maximum.

That is, at an initial stage of the engine from the start-up to the low-speed region, since inner coil spring 70 has set load W1, inner coil spring 70 cannot be compressively deformed as shown in FIG. 5 until the discharge fluid pressure that acts on cam ring 55, namely, the fluid pressure within control fluid chamber 66, exceeds set load W1 of inner coil spring 70. When the discharge fluid pressure exceeds set load W1 of inner coil spring 70, inner coil spring 70 is compressively deformed and the spring load of inner coil spring 70 is increased. When the discharge fluid pressure is further increased to bring cam ring 55 into the position shown in FIG. 8, set load W2 of outer coil spring 71 is applied to cam ring 55 in addition to the spring load of inner coil spring 70. Thus, the force that biases cam ring 55, namely, the integrated spring load of inner and outer coil springs 70 and 71, is discontinuously and nonlinearly increased, that is, stepwisely increased. When the discharge fluid pressure exceeds set load W2 of outer coil spring 71, both inner coil spring 70 and outer coil spring 71 are compressively deformed so that the integrated spring load of inner coil spring 70 and outer coil spring 71 is increased. Here, a slope of increase in the load of each of inner and outer coil springs 70 and 71 with respect to the deformation amount of each of inner and outer coil springs 70 and 71 is given as a spring constant of each of inner and outer coil springs 70 and 71. Under the condition that the discharge fluid pressure exceeds set load W2, the spring constant of outer coil spring 71 is added to the spring constant of inner coil spring 70, and the slope of increase in the load of inner coil spring 70 is shifted to the slope of increase in the integrated spring load of inner coil spring 70 and outer coil spring 71.

As explained above, when the discharge fluid pressure reaches fluid pressure P1 along with the increase in engine speed, cam ring 55 starts to displace against the spring force of inner coil spring 70 and thereby suppress the rise of the discharge fluid pressure. After that, when an amount of the displacing movement of cam ring 55 reaches a predetermined value, the spring force of outer coil spring 71 is added to the spring force of inner coil spring 70 to thereby cause increase in a sum of the spring constant of inner coil spring 70 and the spring constant of outer coil spring 71. Further, since there occurs discontinuous increase from set load W1 of inner coil spring 70 to set load W2 of outer coil spring 71, the swing movement of cam ring 55 starts again after the discharge fluid pressure is increased to fluid pressure P2. That is, since the integrated spring load of inner coil spring 70 and outer coil spring 71 stepwisely acts on cam ring 55, the integrated spring characteristic of inner and outer coil springs 70 and 71 can be indicated by a nonlinear curve to thereby cause a specific variation in the swing movement of cam ring 55.

In other words, in the embodiment, owing to the nonlinearity of the integrated spring characteristic of inner and outer coil springs 70 and 71, the discharge fluid pressure has the characteristic indicated by the thick solid line in FIG. 10 which is closer to the necessary fluid pressure indicated by the broken line in FIG. 10. Thus, in the embodiment, it is possible to bring the discharge fluid pressure, i.e., the control fluid pressure, closer to the necessary fluid pressure. As a result, power loss or energy consumption which is caused by an unnecessary rise in fluid pressure can be sufficiently reduced.

Further, with the arrangement of two inner and outer coil springs 70 and 71, the respective set loads of inner and outer coil springs 70 and 71 can be optionally set in accordance with variation in the discharge fluid pressure. Therefore, optimal spring forces for the discharge fluid pressure can be set.

Further, with the arrangement of first and second plungers 72 and 73 which are disposed on the side of the tip ends of inner and outer coil springs 70 and 71, an assembly work of inner and outer coil springs 70 and 71 relative to pump housing 51 can be facilitated. In addition, inner and outer coil springs 70 and 71 can be deformed to smoothly compress and expand without being twisted. In a case where an amount of the respective axial movement of first and second plungers 72 and 73 or an amount of the swing movement of arm 67 is too small, plunger 72 can be omitted and upper end portion 70*b* of inner coil spring 70 can be arranged in direct contact with lower surface 67*a* of arm 67.

Further, since lower surface 67*a* of arm 67 is formed into the arc-shaped curved surface, variation in a contact angle or a contact point of lower surface 67*a* to an upper surface of first plunger 72 can be decreased. As a result, the deformation of inner coil spring 70 can be stabilized. When the upper surface of first plunger 72 is formed into an arc-shaped curved surface, the same effect as in curved lower surface 67*a* of arm 67 can be attained.

Referring to FIG. 11A to FIG. 14C, an operation of the valve timing control device using oil pump 25 will be explained hereinafter. When the engine is stopped, the operation of oil pump 25 is stopped to thereby stop supply of a fluid pressure of the working oil to phase-advance hydraulic chamber 17 and phase-retard hydraulic chamber 18. In this condition, vane member 3 is rotated in a direction opposite to the clockwise direction as indicated by arrow in FIG. 2, by alternating torque that is previously generated in camshaft 2 immediately after the engine is stopped, and vane member 3 is placed in the maximum phase-advance position shown in FIG. 2 and FIG. 11A.

Figure 11A:
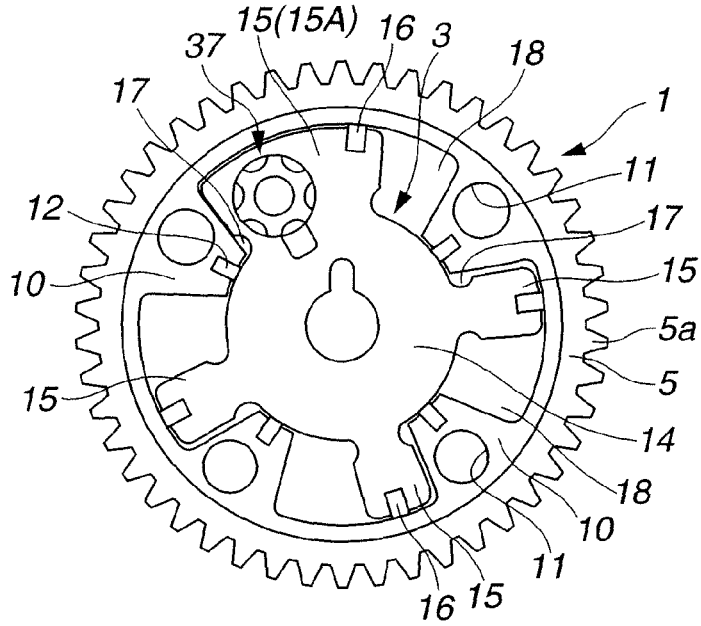
FIG. 11A is an explanatory diagram showing an operating state of the vane member at stop of the engine, in which the vane is placed in the maximum phase-retard position.
Figure 11B:
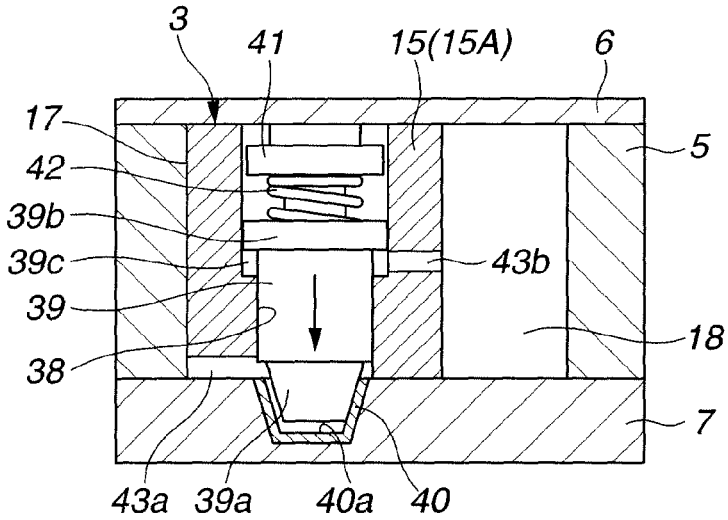
FIG. 11B is an explanatory diagram showing an operating state of the lock mechanism at stop of the engine, in which a lock piston is engaged in a lock hole.

Further, in this condition, end portion 39*a* of lock piston 39 is brought into engagement with lock hole 40*a* of engaging member 40 by the spring force of coil spring 42 as shown in FIG. 11B, thereby restraining the rotation of vane member 3 relative to housing 5 of timing sprocket 1. Thus, the valve timing control device is placed in the lock state in which variable control of the open-and-closure timing of the engine valve is restrained.

Figure 11C:
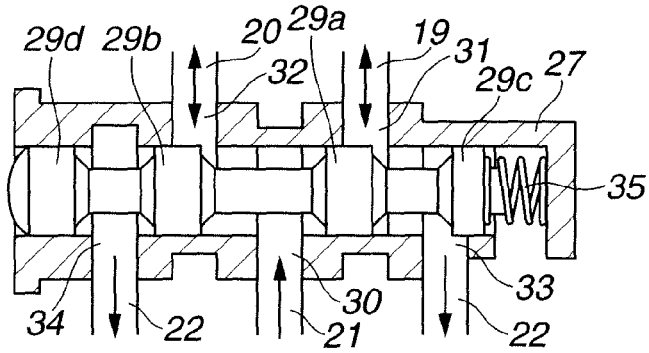
FIG. 11C is an explanatory diagram showing an operating state of a directional control valve at stop of the engine, in which a spool valve body is held in a left operating position.

Further, in this condition, energization to directional control valve 23 by electronic controller 36 is interrupted so that spool valve body 29 is biased to be in the most leftward position shown in FIG. 11C by the spring force of return spring 35.

Next, when the ignition key is turned on to thereby start the engine, an output of the control current from electronic controller 36 to electromagnetic coil 28*b* is prevented for a few seconds from the cranking start. Accordingly, spool valve body 29 is held in the most leftward position shown in FIG. 12C by the spring force of return spring 35. In this position of spool valve body 29, the fluid communication between supply port 30 and second port 32 is established, and the fluid communication between second port 32 and second drain port 34 is blocked by third land 29*b* closing second drain port 34. At the same time, the fluid communication between first port 31 and first drain port 33 is established by second land 29*c* opening first drain port 33.

Figure 12A:
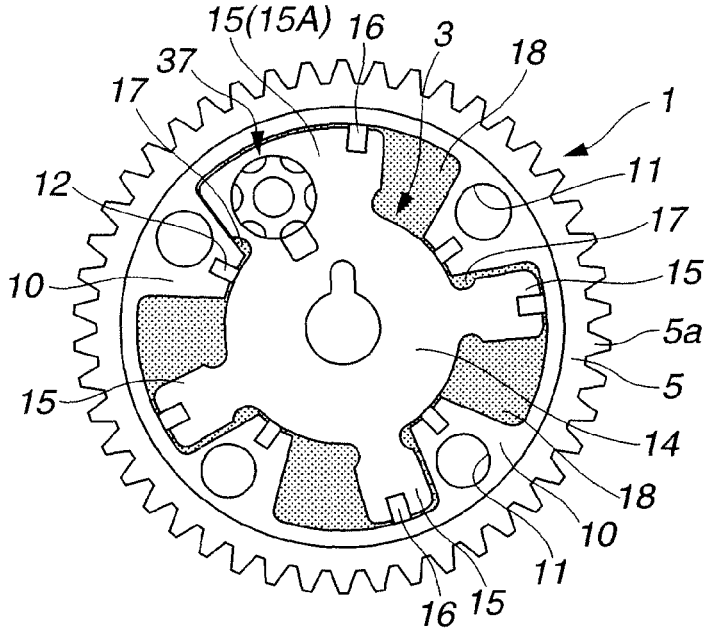
FIG. 12A is an explanatory diagram showing an operating state of the vane member when an ignition key is turned on, in which the vane member is placed in the maximum phase-retard position.
Figure 12B:
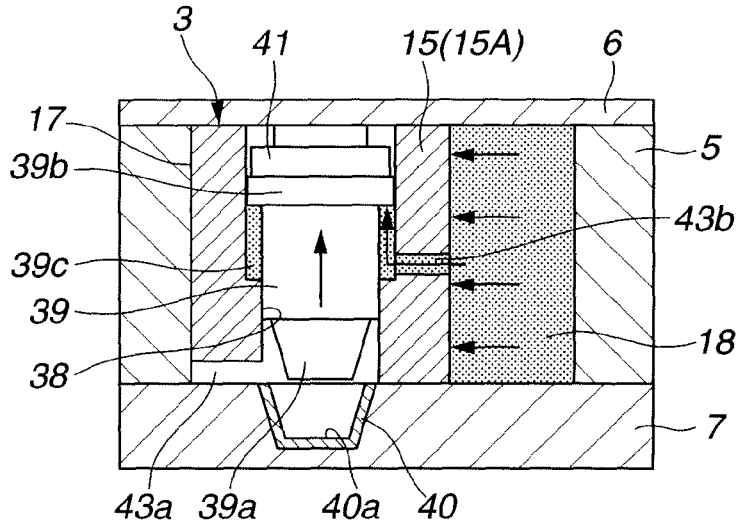
FIG. 12B is an explanatory diagram showing an operating state of the lock mechanism when the ignition key is turned on, in which the lock piston is in a disengaged state relative to the lock hole.
Figure 12C:
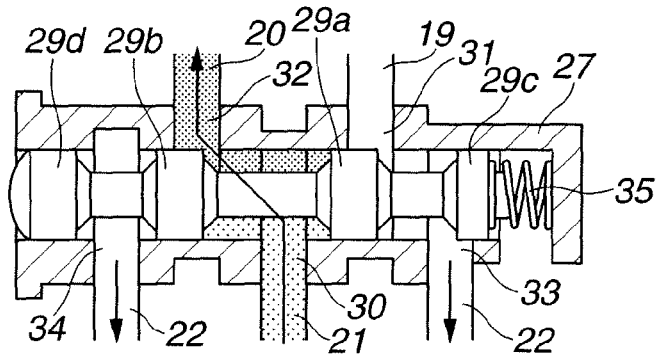
FIG. 12C is an explanatory diagram showing an operating state of the directional control valve when the ignition key is turned on, in which the spool valve body is held in a left operating position.

Accordingly, the fluid pressure discharged from oil pump 25 is introduced from supply passage 21 into valve body 27 through supply port 30 and flows into second fluid passage 20 through second port 32 as indicated by arrow in FIG. 12C. The fluid pressure is then supplied to respective phase-retard hydraulic chambers 18 through corresponding second branch passages 20*b* shown in FIG. 2.

Vane member 3, therefore, is held in the maximum phase-retard position shown in FIG. 12A by the low fluid pressure supplied into respective phase-retard hydraulic chambers 18. As a result, the engine start-up performance can be enhanced.

At this time, the air remaining in respective phase-retard hydraulic chambers 18 is compressed by the low fluid pressure to thereby urge vane member 3 toward the maximum phase-retard position in cooperation with the low fluid pressure.

As the fluid pressure within respective phase-retard hydraulic chambers 18 is increased, the fluid pressure within respective phase-retard hydraulic chambers 18 is supplied to pressure-receiving chamber 39*c* through second oil hole 43*b* and acts on a pressure-receiving surface of large-diameter flange 39*b* of lock piston 39 as shown in FIG. 12B. Lock piston 39 is urged to retreat from and disengaged from lock hole 40*a* against the spring force of coil spring 42. Therefore, vane member 3 is released from the locked state and permitted to rotate relative to housing 5 of timing sprocket 1. Thus, the valve timing control device is brought into the release state in which the variable control of the open-and-closure timing of the engine valve is allowed according to the discharge fluid pressure. However, vane member 3 is held in the maximum phase-retard position owing to the increased fluid pressure within respective phase-retard hydraulic chambers 18.

Timing of retreat and disengagement of end portion 39*a* of lock piston 39 from lock hole 40*a* is the moment at which the fluid pressure discharged from oil pump 25 rapidly raises as indicated by the two-dot chain line in region A of FIG. 10, before arm 67 of cam ring 55 presses inner coil spring 70 downwardly. The moment is about a few seconds elapsed after the ignition key is turned on.

When the engine speed reaches the medium-speed region after the cranking is started, electromagnetic coil 28*b* of directional control valve 23 is energized to excite stator core 28*c* by the output of the control current from electronic controller 36. Upon excitation of stator core 28*c*, moveable plunger 28*d* urges spool valve body 29 to move rightward from the position shown in FIG. 12C to the most rightward position shown in FIG. 13C. In the most rightward position, the fluid communication between supply port 30 and first port 31 is established and the fluid communication between first port 31 and first drain port 33 is blocked. At the same time, the fluid communication between second port 32 and second drain port 34 is established.

Figure 13A:
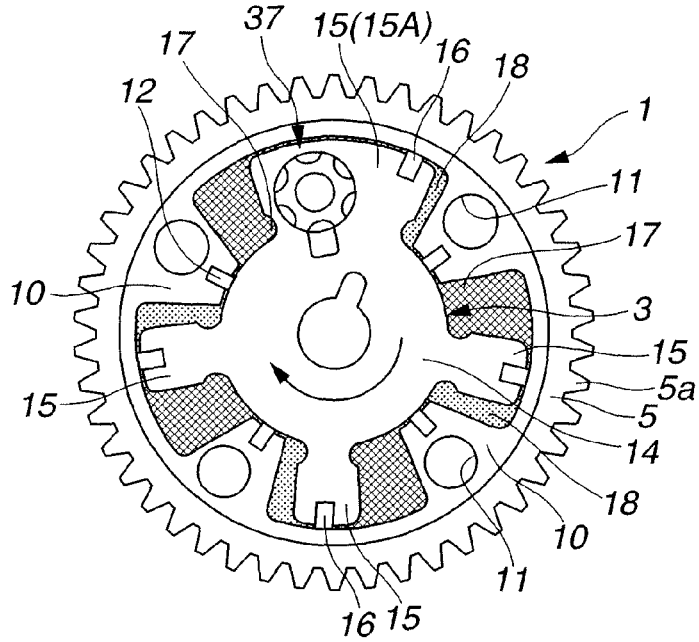
FIG. 13A is an explanatory diagram showing an operating state of the vane member when the engine is operated in a medium-speed region, in which the vane member is placed in a phase-advance position.
Figure 13B:
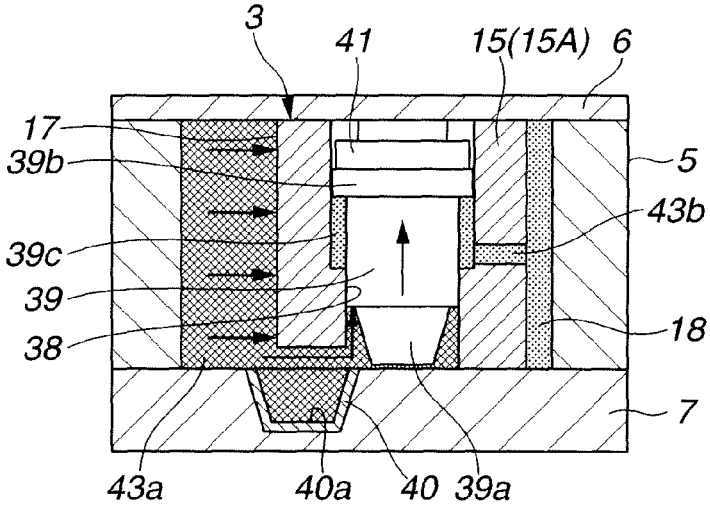
FIG. 13B is an explanatory diagram showing an operating state of the lock mechanism when the engine is operated in the medium-speed region, in which the lock piston is in a disengaged state relative to the lock hole.
Figure 13C:
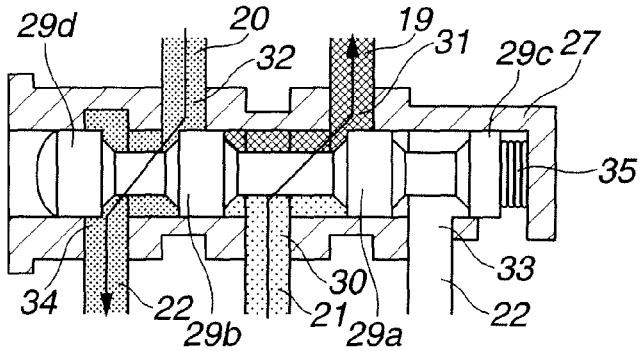
FIG. 13C is an explanatory diagram showing an operating state of the directional control valve when the engine is operated in the medium-speed region, in which the spool valve body is held in a right operating position.

Accordingly, the fluid pressure discharged from oil pump 25 is introduced from supply passage 21 into valve body 27 through supply port 30 and flows into first fluid passage 19 through first port 31 as indicated by arrow in FIG. 13C. The fluid pressure is then supplied to respective phase-advance hydraulic chambers 17 through first passage 19*a* and first branch passages 19*b* shown in FIG. 1. Therefore, the fluid pressure within respective phase-advance hydraulic chambers 17 is increased. On the other hand, the fluid pressure within respective phase-retard hydraulic chambers 18 is discharged into second fluid passage 20. The fluid pressure passing through second fluid passage 20 flows into valve body 27 through second port 32 and then flows into drain passage 22 through second drain port 34 as indicated by arrow in FIG. 13C. The fluid pressure passing through drain passage 22 is then returned to oil pan 24. Therefore, the fluid pressure within respective phase-retard hydraulic chambers 18 is reduced.

The fluid pressure within pressure-receiving chamber 39*c* is decreased due to reduction of the fluid pressure within respective phase-retard hydraulic chambers 18. However, as shown in FIG. 13B, lock piston 39 is held retreated from lock hole 40*a* against the spring force of coil spring 42 by the high fluid pressure that is supplied from first oil hole 43*a* into lock hole 40*a* as the fluid pressure within respective phase-advance hydraulic chambers 17 is increased. Vane member 3 is free from the locked state and urged to rotate in the clockwise direction in FIG. 13A, namely, in the same direction as the rotational direction of camshaft 2, by the increased fluid pressure within respective phase-advance hydraulic chambers 17 and thereby quickly vary a relative rotation phase of the crankshaft and camshaft 2 toward the phase-advance side.

As a result, a valve overlap of an intake valve and an exhaust valve is slightly increased to attain an internal exhaust gas recirculation (EGR) and thereby reduce emission of HC present in exhaust gas as explained later.

When the engine speed further rises and reaches the high-speed region, energization to electromagnetic coil 28*b* of directional control valve 23 by electronic controller 36 is maintained to continuously supply the fluid pressure to respective phase-advance hydraulic chambers 17. In this condition, vane member 3 is further rotated in the clockwise direction in FIG. 3 and held in the maximum rotational position shown in FIG. 3 to thereby vary the relative rotation phase of the crankshaft and camshaft 2 toward the maximum phase-advance side. As a result, the valve overlap of the intake valve and the exhaust valve is increased so that an engine output can be enhanced.

Figure 14A:
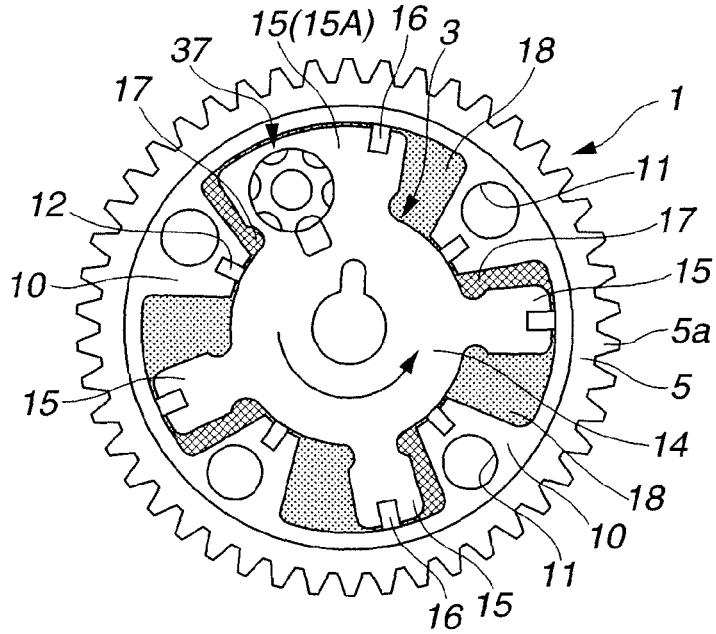
FIG. 14A is an explanatory diagram showing an operating state of the vane member at idling of the engine, in which the vane member is placed in a phase-retard position.

When the engine operation is shifted to idling, the output of the control current from electronic controller 36 to electromagnetic coil 28*b* of directional control valve 23 is interrupted to thereby stop excitation of stator core 28*c*. Spool valve body 29, therefore, is urged to move to the most leftward position by the spring force of return spring 35 as shown in FIG. 14C. In the most leftward position, the fluid communication between supply port 30 and second port 32 is established, and the fluid communication between second port 32 and second drain port 34 is blocked by third land 29*b* closing second drain port 34. At the same time, the fluid communication between first port 31 and first drain port 33 is established by second land 29*c* opening first drain port 33.

Accordingly, the fluid pressure discharged from oil pump 25 is introduced from supply passage 21 into valve body 27 through supply port 30 and flows into second fluid passage 20 through second port 32 as indicated by arrow in FIG. 14C. The fluid pressure is then supplied to respective phase-retard hydraulic chambers 18 through corresponding second branch passages 20*b* shown in FIG. 2, so that the fluid pressure within respective phase-retard hydraulic chambers 18 is increased. On the other hand, the fluid pressure within respective phase-advance hydraulic chambers 17 is discharged into first fluid passage 19. The fluid pressure passing through first fluid passage 19 flows into valve body 27 through first port 31 and then flows into drain passage 22 through first drain port 33 as indicated by arrow in FIG. 14C. The fluid pressure passing through drain passage 22 is then returned to oil pan 24. Therefore, the fluid pressure within respective phase-advance hydraulic chambers 17 is reduced.

Figure 14B:
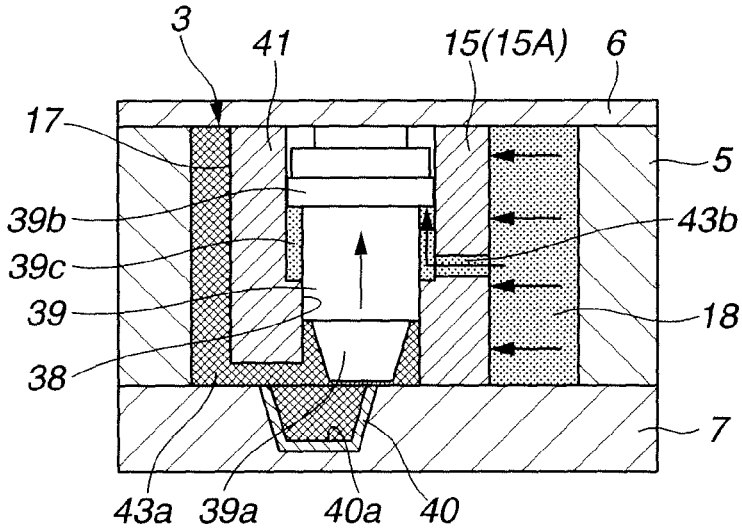
FIG. 14B is an explanatory diagram showing an operating state of the lock mechanism at idling of the engine, in which the lock piston is moving out from the lock hole.
Figure 14C:
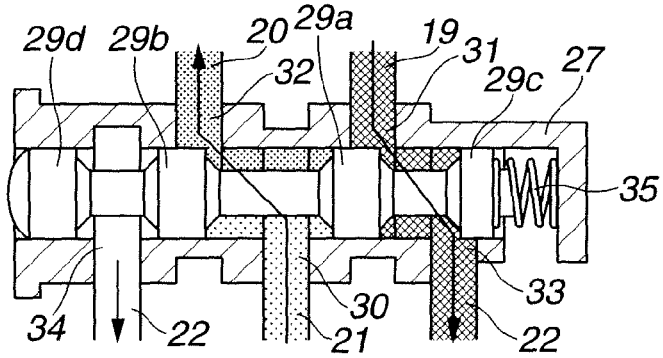
FIG. 14C is an explanatory diagram showing an operating state of the directional control valve at idling of the engine, in which the spool valve body is held in a left operating position.

In this condition, as shown in FIG. 14B, lock piston 39 is held to retreat from lock hole 40*a* by the fluid pressure within pressure-receiving chamber 39*c* into which the increased fluid pressure within respective phase-retard hydraulic chambers 18 is introduced. Therefore, as shown in FIG. 14A, vane member 3 is released from the locked state and urged to rotate toward the maximum phase-retard side by the increased fluid pressure within respective phase-retard hydraulic chambers 18. As a result, combustion in the engine becomes good and therefore idling of the engine can be stabilized.

As described above, in the embodiment, oil pump 25 has the specific construction that employs inner coil spring 70 and outer coil spring 71. In this construction, inner coil spring 70 has the biasing force which is set such that before cam ring 55 is displaced against the biasing force, the valve timing control device is shifted from the lock state in which variable control of the open-and-closure timing of the engine valve is restrained, to the release state in which the variable control of the open-and-closure timing of the engine valve is allowed according to the discharge fluid pressure. That is, before inner coil spring 70 is urged to be compressively deformed by cam ring 55, the valve timing control device is shifted to the release state to start the variable control of the open-and-closure timing of the engine valve. Further, when the engine speed (or pump speed) reaches a predetermined value or more, cam ring 55 is urged by the biasing force of outer coil spring 71. Thus, the integrated biasing force of inner coil spring 70 and outer coil spring 71 is stepwisely exerted on cam ring 55. As a result, it is possible to provide good raise of the discharge fluid pressure discharged from oil pump 25 at the engine start-up, and therefore, improve an operating response of the valve timing control device using oil pump 25 at the engine start-up. Further, it is possible to reduce the power loss (or energy consumption) that occurs when the engine speed (or pump speed) reaches the predetermined value or more.

That is, oil pump 25 is used for supplying the lubricating oil that is discharged from the discharge outlet, to the slide parts of the engine, and also used for actuating the valve timing control device. As indicated by the characteristic curve in region A shown in FIG. 10, the good characteristic of raise of the discharge fluid pressure that is produced by oil pump 25 at the initial stage of the engine operation is attained. Therefore, it is possible to improve an operating response upon varying the relative rotational phase between timing sprocket 5 and camshaft 2 toward the phase-retard side.

Further, oil pump 25 has the characteristic of the discharge fluid pressure indicated by the characteristic curve (indicated by the thick solid line) in regions A to D in FIG. 10, owing to the nonlinear characteristic of the integrated spring force of inner and outer coil springs 70 and 71. As seen from FIG. 10, the characteristic curve of the discharge fluid pressure sufficiently approaches the characteristic curve (indicated by the broken line) of the necessary fluid pressure. As a result, it is possible to remarkably reduce power loss or energy consumption that is caused due to unnecessary fluid pressure rise.

Further, oil pump 25 can be reduced in size and weight, serving for enhancing installability to the engine. Oil pump 25 can be simplified in construction and also can provide an excellent pump efficiency.

The valve timing control device is not limited to the embodiment having the above-described construction, and may be constructed to be hydraulically driven.

Further, the valve timing control device is not limited to the embodiment used on the intake side, and can be applied to an exhaust side and both the intake side and the exhaust side.

This application is based on a prior Japanese Patent Application No. 2007-269631 filed on Oct. 17, 2007. The entire contents of the Japanese Patent Application No. 2007-269631 are hereby incorporated by reference.

Although the invention has been described above by reference to a certain embodiment of the invention and modifications of the embodiments, the invention is not limited to the embodiments and modifications described above. Further variations of the embodiments and modifications described above will occur to those skilled in the art in light of the above teachings. The scope of the invention is defined with reference to the following claims.

What is claimed is:

1. A variable displacement pump for supplying a fluid pressure to a valve timing control device that has a lock state at engine start-up in which variable control of an open-and-closure timing of an engine valve of an internal combustion engine is restrained, and a release state after engine start-up in which the variable control of an open-and-closure timing of an engine valve is allowed by a fluid pressure, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed with a set load and applies a biasing force to the moveable member in such a direction as to increase the volumes of the working fluid chambers when the moveable member is displaced against a biasing force of the first biasing member by a predetermined amount or more, wherein the biasing force of the first biasing member is set such that the valve timing control device is shifted to the release state according to the discharge fluid pressure before the moveable member is displaced against the biasing force of the first biasing member.

2. The variable displacement pump as claimed in claim 1, wherein the valve timing control device comprises:

a driving rotary member to which a rotational force is transmitted from a crankshaft of the engine;

a driven rotary member that transmits the rotational force to a camshaft of the engine;

a plurality of hydraulic chambers that are disposed between the driving rotary member and the driven rotary member, the hydraulic chambers being varied in volume due to a fluid pressure within the hydraulic chambers to thereby cause a relative rotation of the driving rotary member and the driven rotary member;

a lock piston that is disposed on a side of one of the driving rotary member and the driven rotary member, the lock piston being biased to move toward and engage with the other of the driving rotary member and the driven rotary member by a third biasing member and move apart from and disengage from the other of the driving rotary member and the driven rotary member according to the fluid pressure within the hydraulic chambers;

an engaging portion that is disposed on a side of the other of the driving rotary member and the driven rotary member and comes into engagement with the lock piston to restrain the relative rotation of the driving rotary member and the driven rotary member; and a fluid pressure supply and discharge mechanism that allows supply and discharge the fluid pressure with respect to the hydraulic chambers and the lock piston, wherein a biasing force of the third biasing member is set such that the lock piston is released from the engagement with the engaging portion before the moveable member is displaced against the biasing force of the first biasing member.

3. The variable displacement pump as claimed in claim 1, wherein the pump unit comprises a rotor that is rotatably driven by the engine and a plurality of vanes that are disposed so as to project from the rotor and retract into the rotor and define the working fluid chambers by projecting toward the moveable member, and the chamber volume varying mechanism allows an eccentric movement of the moveable member relative to the rotor so as to vary an eccentric amount of a central axis of the moveable member with respect to a central axis of the rotor.

4. The variable displacement pump as claimed in claim 3, wherein the working fluid is a lubricating oil that is used for lubricating slide parts of the engine.

5. A variable displacement pump for supplying a fluid pressure for actuating a valve timing control device that variably controls an open-and-closure timing of an engine valve of an internal combustion engine, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed with a set load and applies a biasing force to the moveable member in such a direction as to increase the volumes of the working fluid chambers when the moveable member is displaced against a biasing force of the first biasing member by a predetermined amount or more, wherein the biasing force of the first biasing member is set such that the valve timing control device is actuated by the discharge fluid pressure under a condition that the moveable member is urged by only the biasing force of the first biasing member.

6. The variable displacement pump as claimed in claim 5, wherein the valve timing control device comprises:

a driving rotary member to which a rotational force is transmitted from a crankshaft of the engine;

a driven rotary member that transmits the rotational force to a camshaft of the engine;

a phase-advance hydraulic chamber that is disposed between the driving rotary member and the driven rotary member and variable in volume to advance the open-and-closure timing of the engine valve when the volume of the phase-advance hydraulic chamber is increased;

a phase-retard hydraulic chamber that is disposed between the driving rotary member and the driven rotary member and variable in volume to retard the open-and-closure timing of the engine valve when the volume of the phase-retard hydraulic chamber is increased; and a fluid pressure supply and discharge mechanism that allows supply and discharge the fluid pressure with respect to the phase-advance hydraulic chamber and the phase-retard hydraulic chamber, wherein the fluid pressure supply and discharge mechanism acts to control the fluid pressure so as to increase at least the volume of the phase-advance hydraulic chamber under a condition that the moveable member is urged by the biasing force of the first biasing member but free from the biasing force of the second biasing member.

7. The variable displacement pump as claimed in claim 5, wherein the pump unit comprises a rotor that is rotatably driven by the engine and disposed inside the moveable member, and a plurality of vanes that are moveably disposed to project from the rotor and retract into the rotor and define the working fluid chambers in cooperation with the moveable member, and the chamber volume varying mechanism allows an eccentric movement of the moveable member relative to the rotor so as to vary an eccentric amount of a central axis of the moveable member with respect to a central axis of the rotor.

8. The variable displacement pump as claimed in claim 7, wherein the working fluid is a lubricating oil that is used for lubricating slide parts of the engine.

9. A valve timing control system for an internal combustion engine, comprising:

a valve timing control device that has a lock state at engine start-up in which variable control of an open-and-closure timing of an engine valve of the engine is restrained, and a release state after engine start-up in which the variable control of an open-and-closure timing of an engine valve is allowed by a fluid pressure; and a variable displacement pump that supplies the fluid pressure to the valve timing control device, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed with a set load and applies a biasing force to the moveable member in such a direction as to increase the volumes of the working fluid chambers when the moveable member is displaced against a biasing force of the first biasing member by a predetermined amount or more, wherein the biasing force of the first biasing member is set such that the valve timing control device is shifted to the release state according to the discharge fluid pressure before the moveable member is displaced against the biasing force of the first biasing member.

10. The valve timing control system as claimed in claim 9, wherein the valve timing control device comprises:

a driving rotary member to which a rotational force is transmitted from a crankshaft of the engine;

a driven rotary member that transmits the rotational force to a camshaft of the engine;

a plurality of hydraulic chambers that are disposed between the driving rotary member and the driven rotary member, the hydraulic chambers being varied in volume due to a fluid pressure within the hydraulic chambers to thereby cause a relative rotation of the driving rotary member and the driven rotary member;

a lock piston that is disposed on a side of one of the driving rotary member and the driven rotary member, the lock piston being biased to move toward and engage with the other of the driving rotary member and the driven rotary member by a third biasing member and move apart from and disengage from the other of the driving rotary member and the driven rotary member according to the fluid pressure within the hydraulic chambers;

an engaging portion that is disposed on a side of the other of the driving rotary member and the driven rotary member and comes into engagement with the lock piston to restrain the relative rotation of the driving rotary member and the driven rotary member; and a fluid pressure supply and discharge mechanism that allows supply and discharge the fluid pressure with respect to the hydraulic chambers and the lock piston, wherein a biasing force of the third biasing member is set such that the lock piston is released from the engagement with the engaging portion before the moveable member is displaced against the biasing force of the first biasing member.

11. The valve timing control system as claimed in claim 9, wherein the valve timing control device comprises:

a driving rotary member to which a rotational force is transmitted from a crankshaft of the engine;

a driven rotary member that transmits the rotational force to a camshaft of the engine;

a phase-advance hydraulic chamber that is disposed between the driving rotary member and the driven rotary member and variable in volume to advance the open-and-closure timing of the engine valve when the volume of the phase-advance hydraulic chamber is increased;

a phase-retard hydraulic chamber that is disposed between the driving rotary member and the driven rotary member and variable in volume to retard the open-and-closure timing of the engine valve when the volume of the phase-retard hydraulic chamber is increased; and a fluid pressure supply and discharge mechanism that allows supply and discharge the fluid pressure with respect to the phase-advance hydraulic chamber and the phase-retard hydraulic chamber, wherein the fluid pressure supply and discharge mechanism acts to control the fluid pressure so as to increase at least the volume of the phase-advance hydraulic chamber under a condition that the moveable member is urged by the biasing force of the first biasing member but free from the biasing force of the second biasing member.

12. The valve timing control system as claimed in claim 9, wherein the pump unit comprises a rotor that is rotatably driven by the engine and disposed inside the moveable member, and a plurality of vanes that are moveably disposed to project from the rotor and retract into the rotor and define the working fluid chambers in cooperation with the moveable member, and the chamber volume varying mechanism allows an eccentric movement of the moveable member relative to the rotor so as to vary an eccentric amount of a central axis of the moveable member with respect to a central axis of the rotor.

13. The valve timing control system as claimed in claim 12, wherein the working fluid is a lubricating oil that is used for lubricating slide parts of the engine.

14. A valve timing control device for variably controlling an open-and-closure timing of an engine valve of an internal combustion engine, the valve timing control device comprising:

a variable displacement pump that supplies a fluid pressure to the valve timing control device, the variable displacement pump comprising:

a pump unit including a suction portion, a discharge portion and a plurality of working fluid chambers, the pump unit being driven by the engine so as to discharge a working fluid that is introduced from the suction portion into the working fluid chambers, from the discharge portion according to change in volume of the working fluid chambers; and a chamber volume varying mechanism comprising:

a moveable member that is displaceable according to a discharge pressure of the working fluid discharged from the discharge portion, the chamber volume varying mechanism varying the volumes of the working fluid chambers that are opened to the discharge portion in accordance with displacement of the moveable member, a first biasing member that always biases the moveable member in such a direction as to increase the volumes of the working fluid chambers; and a second biasing member that is disposed at a compressed state and applies a biasing force to the moveable member in such a direction as to increase the volumes of the working fluid chambers when the moveable member is displaced against a biasing force of the first biasing member by a predetermined amount or more, wherein the valve timing control device is constructed to be actuated to variably control the open-and-closure timing of the engine valve by the discharge pressure of the working fluid under a condition that the moveable member is urged by the biasing force of the first biasing member.

15. The valve timing control device as claimed in claim 14, wherein the valve timing control device further comprises:

a driving rotary member to which a rotational force is transmitted from a crankshaft of the engine;

a driven rotary member that transmits the rotational force to a camshaft of the engine;

a plurality of hydraulic chambers that are disposed between the driving rotary member and the driven rotary member, the hydraulic chambers being varied in volume due to a fluid pressure within the hydraulic chambers to thereby cause a relative rotation of the driving rotary member and the driven rotary member;

a lock piston that is disposed on a side of one of the driving rotary member and the driven rotary member, the lock piston being biased to move toward and engage with the other of the driving rotary member and the driven rotary member by a third biasing member and move apart from and disengage from the other of the driving rotary member and the driven rotary member according to the fluid pressure within the hydraulic chambers;

an engaging portion that is disposed on a side of the other of the driving rotary member and the driven rotary member and comes into engagement with the lock piston to restrain the relative rotation of the driving rotary member and the driven rotary member; and a fluid pressure supply and discharge mechanism that allows supply and discharge the fluid pressure with respect to the hydraulic chambers and the lock piston, wherein a biasing force of the third biasing member is set such that the lock piston is released from the engagement with the engaging portion before the moveable member is displaced against the biasing force of the first biasing member.

16. The valve timing control device as claimed in claim 15, wherein the driving rotary member comprises a housing that includes a plurality of partitions on an inner circumferential side thereof, and the driven rotary member is disposed within the housing so as to be rotatable relative to the housing and includes a plurality of blades each extending in a radially outward direction of the driven rotary member so as to define a pair of the hydraulic chambers between the adjacent partitions which are opposed to the blade in a circumferential direction of the driving rotary member.

17. The valve timing control device as claimed in claim 16, wherein the engaging portion is a lock hole that is engageable with an end portion of the lock piston.

18. The valve timing control device as claimed in claim 17, wherein the lock piston is moveable in an axial direction thereof such that the end portion of the lock piston is engaged with the lock hole and disengaged from the lock hole.

19. The valve timing control device as claimed in claim 14, further comprising:

a driving rotary member to which a rotational force is transmitted from a crankshaft of the engine;

a driven rotary member that transmits the rotational force to a camshaft of the engine;

a phase-advance hydraulic chamber that is disposed between the driving rotary member and the driven rotary member and variable in volume to advance the open-and-closure timing of the engine valve when the volume of the phase-advance hydraulic chamber is increased;

a phase-retard hydraulic chamber that is disposed between the driving rotary member and the driven rotary member and variable in volume to retard the open-and-closure timing of the engine valve when the volume of the phase-retard hydraulic chamber is increased; and a fluid pressure supply and discharge mechanism that allows supply and discharge the fluid pressure with respect to the phase-advance hydraulic chamber and the phase-retard hydraulic chamber, wherein the fluid pressure supply and discharge mechanism acts to control the fluid pressure so as to increase at least the volume of the phase-advance hydraulic chamber under a condition that the moveable member is urged by the biasing force of the first biasing member but free from the biasing force of the second biasing member.

20. The valve timing control device as claimed in claim 19, wherein the driving rotary member comprises a housing that includes a plurality of partitions on an inner circumferential side thereof, and the driven rotary member is disposed within the housing so as to be rotatable relative to the housing and includes a plurality of blades each extending in a radially outward direction of the driven rotary member so as to define the phase-advance hydraulic chamber and the phase-retard hydraulic chamber between the adjacent partitions which are opposed to the blade in a circumferential direction of the driving rotary member.

* * * * *